United States Patent [19]

Gault

[11] 4,076,218

[45] Feb. 28, 1978

[54] LONGSTROKE PUMPING APPARATUS FOR OIL WELLS

[75] Inventor: Robert H. Gault, Midland, Tex.

[73] Assignee: Bethlehem Steel Corporation, Bethlehem, Pa.

[21] Appl. No.: 726,389

[22] Filed: Sep. 24, 1976

[51] Int. Cl.[2] ..... B66C 23/72

[52] U.S. Cl. ..... 254/178; 74/89.22

[58] Field of Search ..... 254/178, 186 R, 150 R, 254/168, 175.5, 175.7; 74/89.22, 590; 166/72, 67; 242/117

[56] References Cited

U.S. PATENT DOCUMENTS

| | | | |
|---|---|---|---|
| 2,370,029 | 2/1945 | Gillespie | 254/178 |
| 3,285,081 | 11/1966 | Kuhns et al. | 74/89.22 |

*Primary Examiner*—Robert J. Spar
*Assistant Examiner*—Kenneth Noland
*Attorney, Agent, or Firm*—Joseph J. O'Keefe; Charles A. Wilkinson

[57] ABSTRACT

A longstroke pumping apparatus for oil well pumping is provided with turnaround capability and more efficient operation by the use of a two section grooved capstan arrangement from which a flexible pumping cable extends down the well and a flexible counterweight cable extends to a counterweight in a counterweight well. The first section of the capstan from which the pumping cable extends has a basically constant diameter while the second section of the rotatable capstan from which the counterweight cable extends is formed from three contiguous interconnected portions. The central portion has a substantially constant diameter and the two end portions have respectively an effectively increasing diameter and an effectively decreasing diameter. Variations of the above basic arrangement are also described.

19 Claims, 24 Drawing Figures

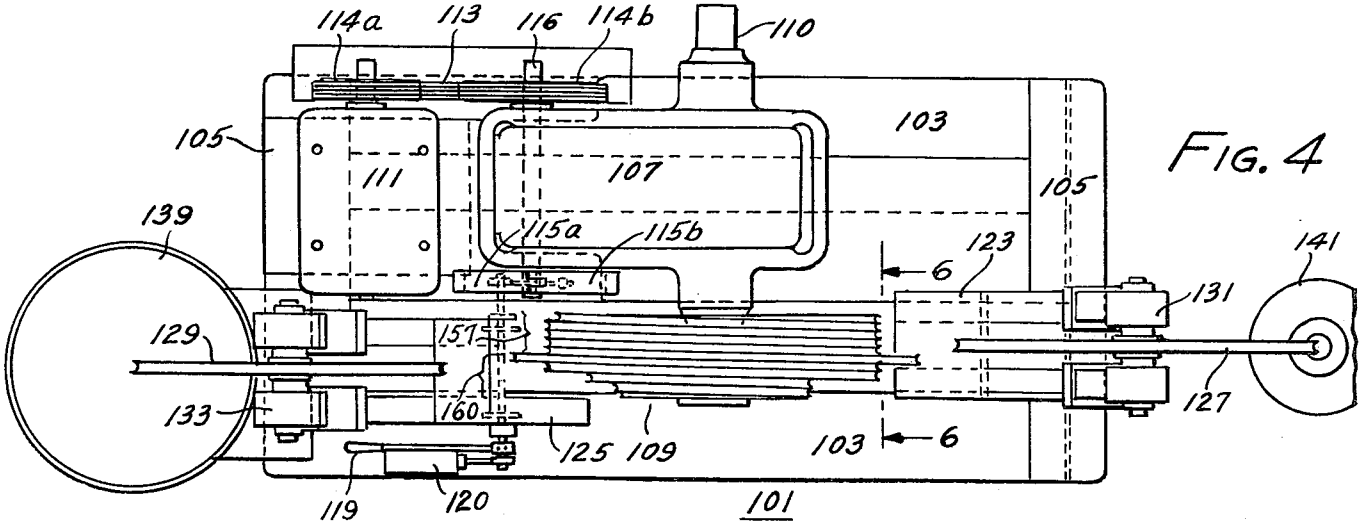
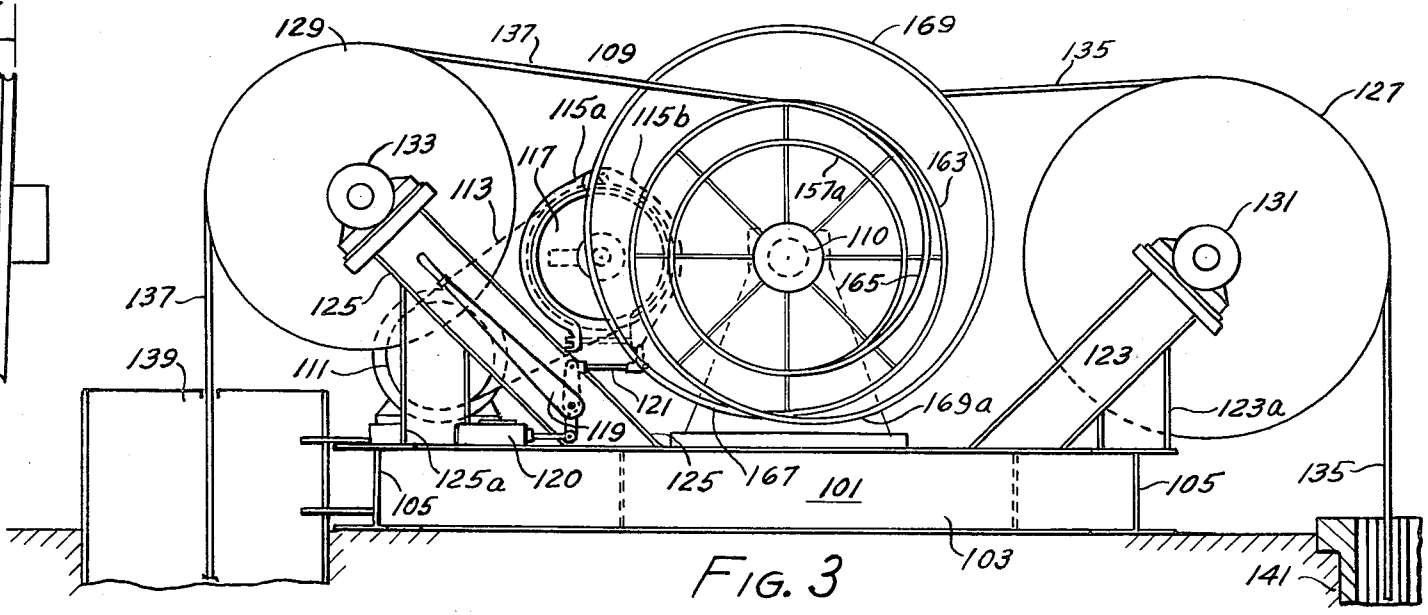
FIG. 3
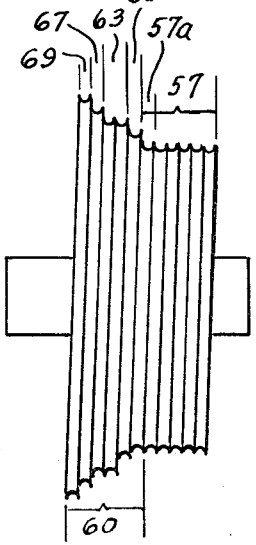
FIG. 2

FIG. 5
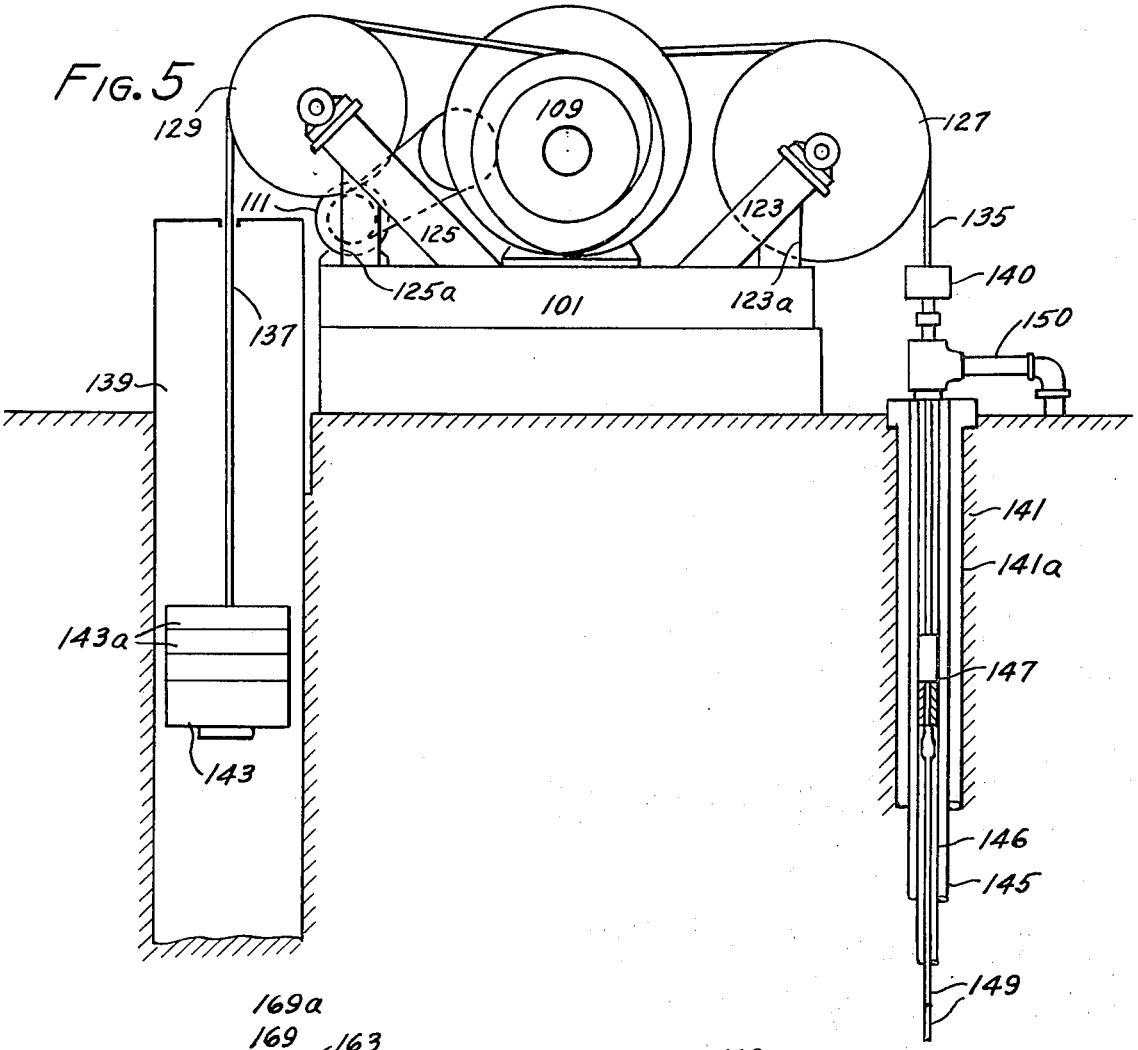
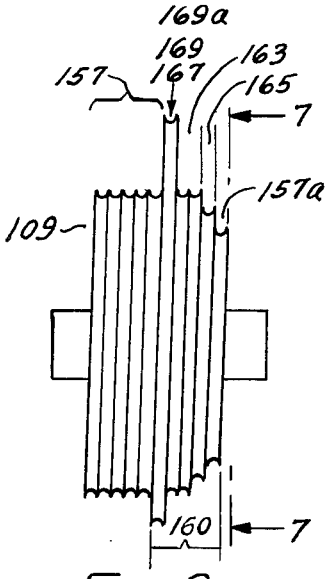
FIG. 6
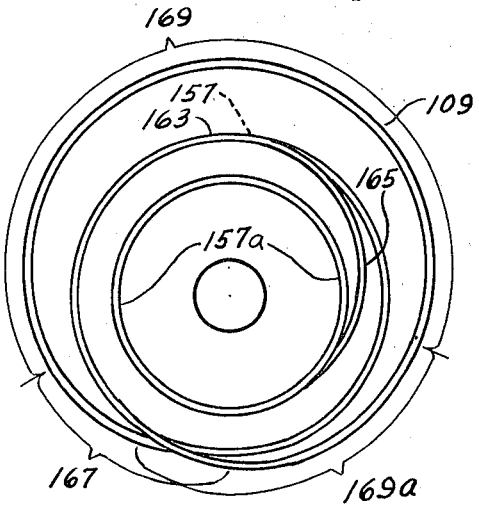
FIG. 7

FIG. 15
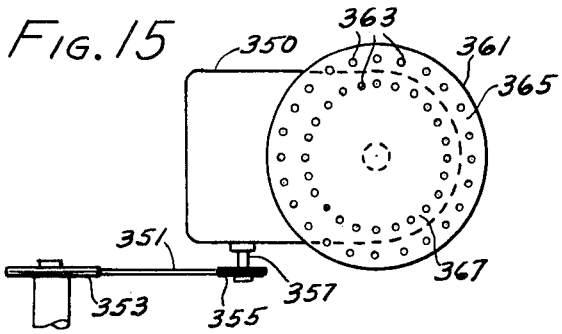
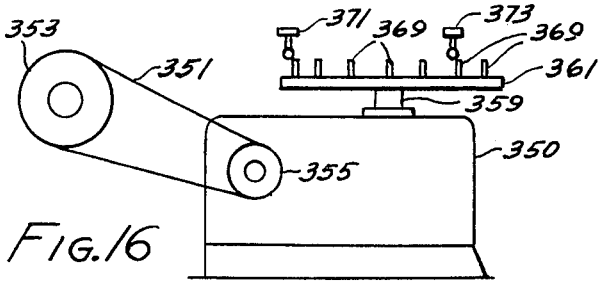
FIG. 16
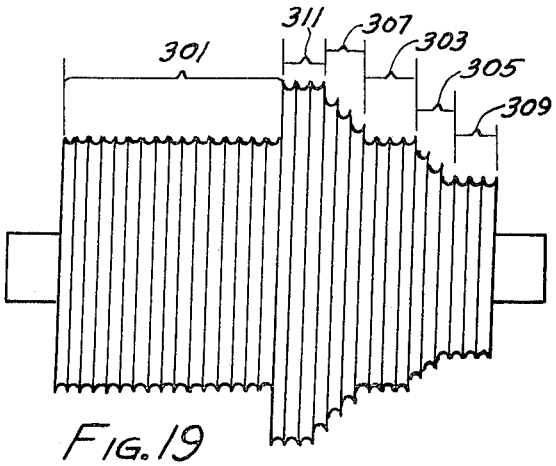
FIG. 19
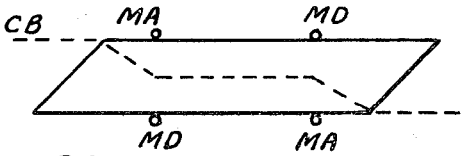
FIG. 20
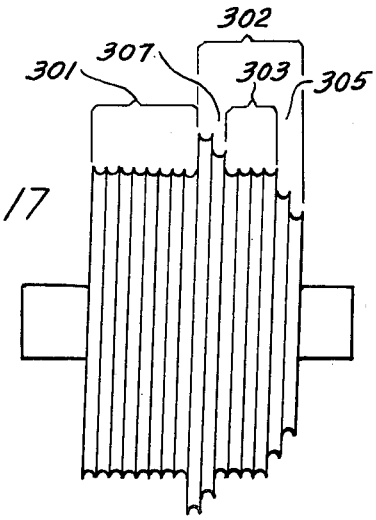
FIG. 17
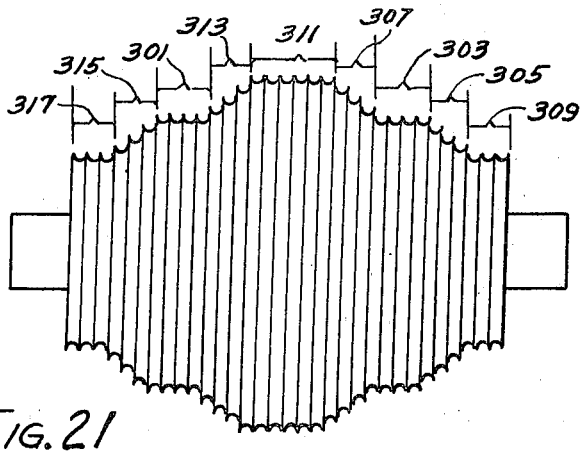
FIG. 21
FIG. 18
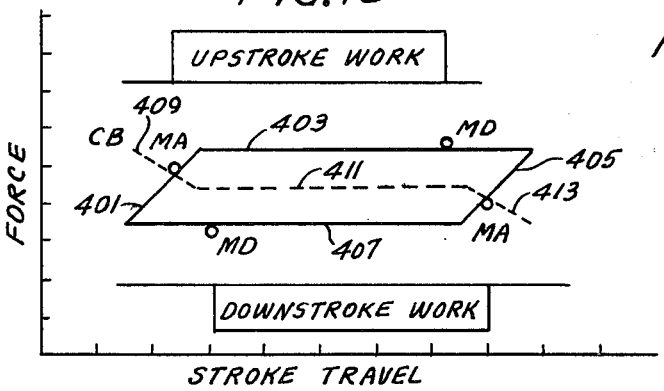
FIG. 22
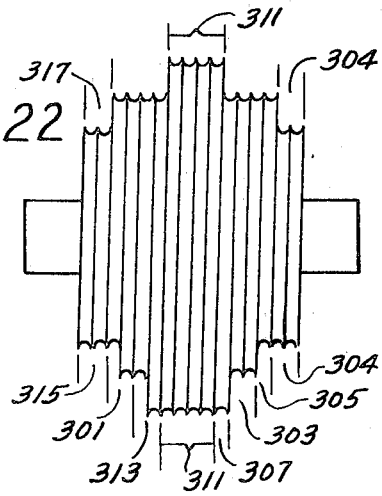

LONGSTROKE PUMPING APPARATUS FOR OIL WELLS

BACKGROUND OF THE INVENTION

This invention relates to a long stroke pumping apparatus and more particularly to long stroke pumping apparatus for oil wells in which a reversible capstan type central pumping unit is used.

Long stroke pumping apparatus has the advantage of slower pumping speed and therefore greater pumping efficiency in comparison with other types of pumping apparatus because the slow stroke provides adequate time for the pump to fill, thus promoting volumetric efficiency, eliminating gas lock and very considerably reducing shock, acceleration and harmonic loading.

Long stroke pumping apparatus using a variable contour capstan or winch type prime mover and a counterweight in a counterweight well to provide pump stroke turn around capability with a reduced input energy is broadly disclosed in U.S. Pat. No. 1,928,532 to Gillespie. The use of a grooved capstan with a counterweight in a well is also shown in U.S. Pat. No. 1,970,596 to Coberly. A further example of a variable diameter capstan or drum used with long stroke pumping apparatus is shown in U.S. Pat. No. 2,370,029 also to Gillespie and still further adaptations of the variable drum principle are disclosed in U.S. Pat. Nos. 3,285,091 and 3,528,305 to Kuhns et al and 3,695,117 to Ewing et al. The Kuhns et al arrangement in U.S. Pat. No. 3,285,081, for example, discloses the use of drums having central concentric portions and inner and outer decreased diameter eccentric portions over which well cables and counterweight cables operate during the turnaround portion of the pumping cycle. While each of the arrangements disclosed in these prior patents provides a reasonably effective long stroke pumping operation, such prior arrangements have not provided maximum attainable efficiency.

SUMMARY OF THE INVENTION

The disadvantages and inefficiencies of the prior art devices have now been eliminated by the present invention.

The basic well, counterweight and pumping apparatus arrangement with which contoured capstan of the present invention may be used is shown in U.S. Pat. No. 3,640,342 issued Feb. 8, 1972 to the present inventor. In accordance with the present invention a capstan or large multigrooved variable diameter sheave or drum replaces the sheave shown in U.S. Pat. No. 3,640,342 and a pair of guide sheaves are preferably, though not necessarily, provided to guide the associated cables into the counterweight well and the oil well. The multigrooved capstan or sheave of the invention has a substantially constant diameter section upon which the wire cable or other flexible linear force transmitting means leading to the well is wrapped and a variable diameter section upon which the cable or other flexible linear force transmitting means leading to the counterweight well is wrapped. The variable diameter capstan section has at least three separate portions, (a) a constant diameter central portion, (b) a portion which effectively decreases in diameter from the constant diameter portion and (c) a portion which effectively increases in diameter from the constant diameter portion. The cable leading to the counterweight well extends from substantially the minimum diameter of the decreasing diameter portion of the counterbalance section of the capstan when the pumping apparatus is at the top of the pumping stroke, and extends from substantially the maximum diameter of the increasing diameter portion of the counterbalance section when the pumping apparatus is at the bottom of the pumping stroke. Since the upstroke load is basically the weight of the sucker rods plus the pump fluid in the well and the downstroke load is basically the weight of the rods, the relative sizes of the constant diameter well cable, or pumping stroke, section of the capstan and the constant diameter portion (a) of the counterweight section of the capstan are sized with respect to each other such that the differential weight between the counterweight and the weight of the oil pump, sucker rod string or pumping strand plus the weight of the oil contained in the well tubing on the upstroke and the differential weight between the weight of the counterweight and the rods only on the downstroke are effectively equal during the central portion of the stroke of the pumping apparatus. Appropriate limit switches or other control means are provided to operate the prime mover or pump motor principally during the time when the respective cables, i.e. the pumping string cable and the counterweight cable or other flexible linear force transmitting means, extend from the constant diameter portions of the capstan. Turn around of the pumping stroke is accomplished both at the top of the pumping stroke and the bottom of the pumping stroke by altering the effective relative weight of the pumping string and the counterweight by changing the effective moment arm of the counterweight at the ends of the pump stroke. This effectively alters the torque arm of the counterweight cable upon the capstan and thus the relative torque applied to the capstan by the counterweight and the pump string. Thus, at the top of the pumping stroke the pump string is made effectively heavier by decreasing the effective moment arm of the counterweight by passing the cable leading to the counterweight from substantially the smallest diameter portion of the decreasing diameter portion of the counterweight section of the capstan, and at the bottom of the pumping stroke the counterweight is made effectively heavier by increasing the effective moment arm of the counterweight by passing the cable leading to the counterweight from substantially the largest diameter portion of the increasing diameter portion of the counterweight section of the capstan. By keeping the cable which extends to the pump string on a constant diameter section of the capstan at all times, it is possible to pass the cable to the pump string directly into the well. However, it will be more usual to pass the cable first over a guide sheave and then into the well.

In some cases it may be desirable to provide an additional cam section on the otherwise constant diameter portion of the pump string section of the capstan so that when the pump string is lighter than normal, e.g. during so-called pump up or filling of the pump and pump tubing with oil on the first few pumping cycles, the counterweight will continue at the end of the pump upstroke to a lower level and the pump string cable will wind upon the capstan surface until it extends from the increased diameter cam section of the pump string section of the capstan. The increased diameter cam section then effectively increases the relative weight of the initially light pump string and pump so that there is sufficient relative weight to reverse the effective torque upon the capstan and turn the pumping cycle around at the top of the pump stroke.

It may also at times be desired to place a decreasing diameter portion at the opposite end of the constant diameter pump string section of the capstan. This decreasing diameter portion will then aid the increasing diameter portion of the counterweight section of the capstan in overcoming the weight of the pump string at the bottom of the well and enable the counterweight to more easily turn the pumping stroke around at the bottom of the pumping cycle. This decreasing diameter portion may be arranged so that if for some reason the pump string and pump does not reverse direction at the bottom of the stroke, the stroke will travel slightly farther and the smaller diameter section will come into play to turn the pumping cycle around. Alternatively this reduced diameter portion may be arranged to cooperate during every stroke with the increased diameter portion of the counterweight section of the capstan to increase the relative torque advantage of the counterweight as compared with the well string upon the capstan. Likewise the alternative increasing diameter portion of the well cable section of the capstan may be arranged to cooperate at the top of every pumping stroke with the decreasing diameter portion of the counterweight section of the capstan to increase the relative torque advantage of the well string upon the capstan and turn the pumping stroke around.

It has been found to be very desirable for the maximum and minimum diameter of the increasing and decreasing diameter portions respectively of the counterweight section of the capstan or winch drum to be continued into an additional constant diameter portion at each end of the counterweight section of the capstan. This preferred arrangement allows a constant maximum counterweight force to be applied during a short period at the bottom of pumping stroke and a constant minimum counterweight force to be applied during a short period at the top of the pumping stroke. By use of this preferred arrangement a maximum effective use of the counterweight and a minimum use of outside energy can be attained.

The particular embodiment of the capstan arrangements of the invention may vary. For example, the counterweight cable and the cable which extends to the well may be the opposite ends of one continuous cable. In this case it will be usual to have the small diameter of the decreasing diameter portion of the counterweight section of the capstan adjacent to the constant diameter pumping string section of the capstan. The increasing diameter portion of the counterweight section of the capstan will then be at the outer end of the capstan. The constant diameter pumping string section and the preferred constant minimum diameter counterweight portion of the counterweight section may in this case be continuations of each other, i.e. a single constant diameter capstan section or portion.

On the other hand, if two separate cables are used for the counterweight cable and the pump string cable, the increasing diameter portion of the counterweight section may be conveniently placed adjacent to the constant diameter pump string section of the capstan and the respective cables attached to the outer ends of the capstan. In this case the largest diameter portion of the counterweight section of the capstan may be made to serve also as a base for an increasing diameter cam portion of the pump string section of the capstan, if such refinement is desired.

As an alternative the two capstan sections, i.e. the pumping string section and the counterweight section, can be formed as separate grooved capstans, sheaves or drums connected by any suitable arrangement or other rotation coordinating means. The increasing and decreasing diameter portions of the capstan may be desirably formed with progressively changing radial portions which are, however, generally concentric with the axis of rotation of the capstan, or, as an alternative, with substantially constant radial dimensions, but arranged eccentrically with respect to the axis of rotation. An eccentric cam arrangement provides a very desirable progressively changing lever or torque arm. A constant spiral dimensioning, on the other hand, enables a decreasing or increasing diameter section to extend around the entire circumference of the capstan and thus allows a smaller capstan drum diameter. Concentrically arranged cam sections extending only partially about the circumference of the capstan are, of course, also possible.

Operation of the motor used to drive the capstan during the central portion of both the upstroke and the downstroke of the pumping apparatus must be carefully coordinated with the rotation of the capstan so that the motor is operated only during the time that the counterweight cable is passing to or from the constant diameter portion of the counterweight section of the capstan plus in some cases an additional period just prior to the time that the cable reaches the constant diameter portion of the capstan. If extra cam portions are used at either or both ends of the pump pump string section of the capstan, the motor will also not be operated when the cable extends from these portions. The capstan motor is preferably rotated by the capstan through its normal coupling with the capstan when the motor is not energized so that the motor will be reversed and brought substantially up to maximum speed by the varying counterbalance or torque arm relationship of the apparatus prior to actual energization of the motor during the central portions of the pumping stroke. The peak load upon the motor is as a consequence reduced and lifting energy requirements are reduced. Up to 25% or more in ordinary power requirements for similar pumping units are thus saved by the arrangement of the invention.

Since the bending of cable over the circumference of a capstan, sheave or drum as the cable passes onto such circumference tends to cause wear and abrasion in the cable, dependent generally upon the radius of the circumference, it is usually advantageous to have the largest radius possible on the various capstan sections in order to minimize the bending of the cable. The length of the pumping stroke may vary also dependent upon the well, the pump and the size of the pumping apparatus. Thus, while the pumping strand or cable and the counterweight cable may be wrapped upon the capstan or drum for three or four or even more wraps, it may be desirable in many cases to use a rather large diameter capstan overall in order to increase the radius of the circumference and decrease the bending of the cable upon the capstan drum. Obviously, if the same number of cable wraps is maintained on the capstan, however, and the diameter of the capstan is increased, the stroke of the pumping apparatus will also be increased. However, the diameter of the capstan can be increased without increasing the pumping stroke, if the number of cable wraps is decreased. Consequently, the actual diameter and contour of the capstan drum may vary in absolute arrangement while maintaining the relationships of the various portions in accordance with the present invention. Thus, with a very large diameter capstan drum, the constant diameter portion of the capstan sections may constitute only a segment of a circle, or an arc, rather than a uniform diameter of an entire crosssection of the capstan drum. The arc will in such case, however, have a constant or uniform radius. The increasing or decreasing diameter portions of the capstan may also constitute only arcs or sections of a circumference rather than full circumferences of the capstan when the capstan diameter is very large. Various intermediate arrangements or relationships will naturally be possible depending upon the relative length of the pumping stroke and the amount of bending desired in the cable.

For simplification and consistency most of the embodiments illustrated hereinafter will show a capstan drum designed to receive several wraps of cable upon its circumference. Portions of the capstan drum may, however, constitute only arcs rather than full circumferences of the capstan surface.

BRIEF DESCRIPTION OF THE FIGURES

FIG. 2 is a view of the capstan of the pumping apparatus taken along lines 2—2 of FIG. 1.

FIG. 3 is an elevation of a second embodiment of the long stroke pumping apparatus of the invention in which two separate lengths of cable are used as the well cable and the counterweight cable.

FIG. 4 is a plan view of the apparatus shown in FIG. 3.

FIG. 5 is a diagrammatic view of the apparatus of FIGS. 3 and 4 installed at a well.

FIG. 6 is a view of the capstan taken along lines 6—6 in FIG. 4.

FIG. 7 is a view of the capstan taken along lines 7—7 of FIG. 6.

FIGS. 15 and 16 are an elevation and plan view respectively of a switch contact arrangement for activating and deactivating the prime mover of the pumping apparatus in the central portion of the pumping cycle.

FIG. 17 is an elevation of an idealized version of the capstan of the invention.

FIG. 18 is a force diagram of the pumping cycle using the capstan of FIG. 17.

FIG. 19 is an elevation of an idealized version of a preferred embodiment of the capstan of the invention showing a preferred constant diameter portion at the ends of the decreasing and increasing spiraled portions of the counterweight section of the capstan of the invention.

FIG. 20 is a force diagram of the pumping cycle using the capstan of FIG. 19.

FIG. 21 is an elevation of an idealized version of a further embodiment of a capstan in accordance with the invention wherein the well cable section of the capstan has a cam portion at both ends.

FIG. 22 is an elevation of an idealized version of an eccentric cam type embodiment of the capstan of the invention showing preferred concentric constant diameter sections used adjacent to the eccentric cam portions of the capstan.

DESCRIPTION OF THE PREFERRED EMBODIMENT

Figure 1:
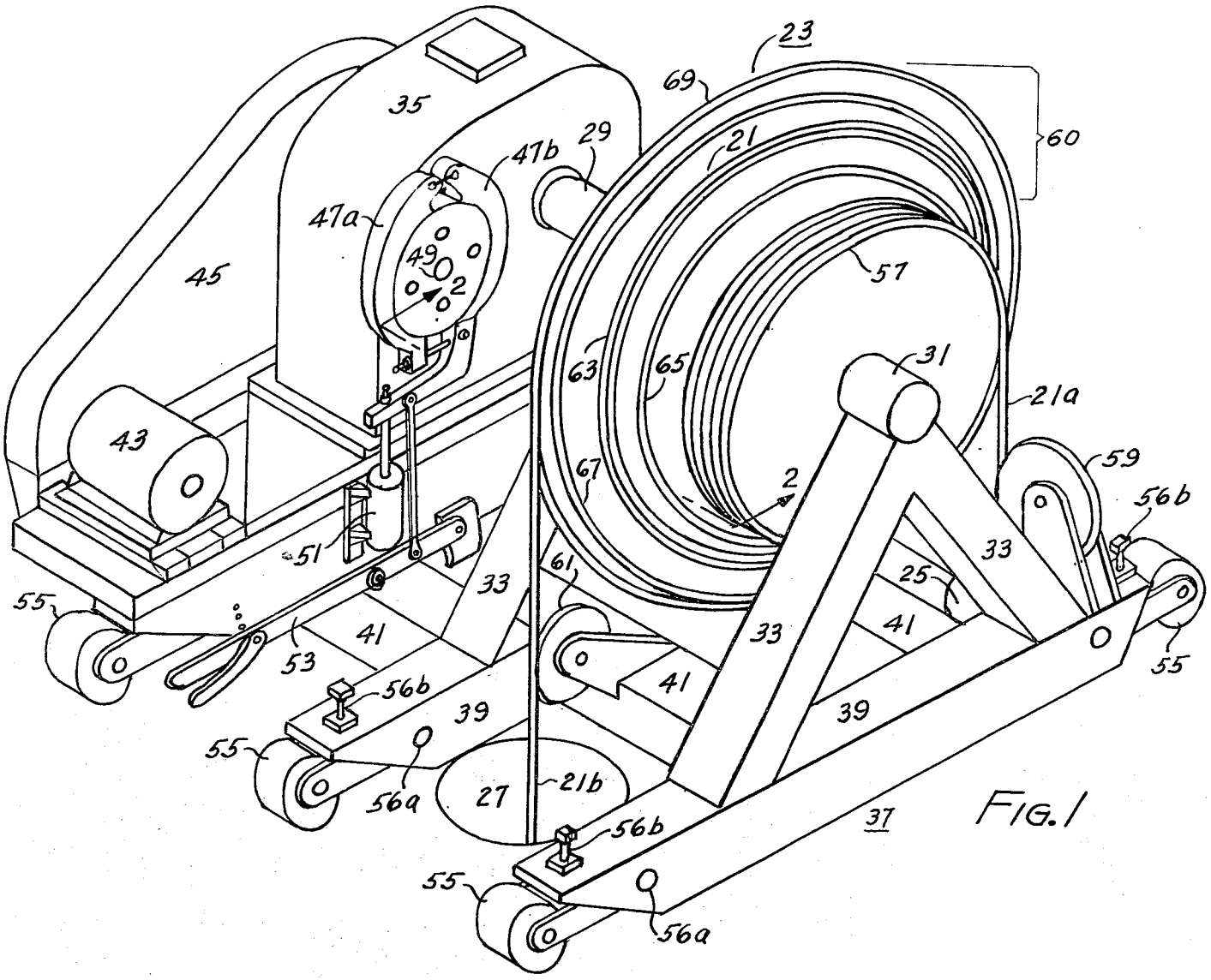
FIG. 1 is a isometric view of one embodiment of the long stroke pumping apparatus of the invention in which a single continuous length of cable is used as both the well cable and the counterweight cable.

The longstroke pumping apparatus of the invention uses a specially designed grooved reversible capstan for motive power. A cable extends from the capstan to a pump string in the oil well and a second cable, or section of the main cable if only a single cable is used, extends from the capstan to a counterweight which is preferably mounted for up and down reciprocal movement in a separate counterweight well. The grooved capstan has a cross-sectional or radial contour which is especially designed for efficient operation with a minimum expenditure of energy. This contour provides a basically uniform or constant diameter capstan section from which the cable extends into or to the oil well, and a variable diameter capstan section from which the cable extends to the counterweight well. The variable diameter capstan section has a central uniform or constant diameter portion and an effectively changing diameter portion at each end of the constant diameter portion. The decreasing diameter portion at one end of the counterbalance section will decrease or spiral down from the constant diameter portion of the counterbalance section and the increasing diameter portion at the other end of the constant diameter portion will increase or spiral up from the constant diameter portion of the counterbalance section of the capstan. The counterbalance balances the average weight of the pump, the sucker rod string or pumping strand and the weight of the oil contained in the well tubing on the upstroke and the weight of the rod string or pumping strand on the downstroke. During operation the counterbalance will exert its weight through the increased lever arm of the maximum diameter portion of the counterbalance section of the capstan at the beginning of the upstroke of the pumping apparatus and will exert its weight through the decreased lever arm of the minimum diameter portion of the counterbalance section at the beginning of the downstroke. In this way the stroke of the pumping apparatus may be reversed at each end of the pumping cycle merely by a change in the effective counterbalance force without the input of any external force. The changing torque exerted upon the capstan by the counterweight through the lever or torque arm of the counterweight cable effects turnaround of the pumping apparatus. Motive power is applied to the capstan from the associated prime mover or motor during the central portion of the pumping cycle after the well string and counterweight have each reached substantially maximum speed and momentum available from the changing torque arms in either direction. The pumping apparatus is thus enabled to operate with a minimum expenditure of energy and minimum strain and wear upon the prime mover. In a preferred embodiment of the invention a constant diameter portion of the counterbalance section of the capstan is provided at both the maximum and the minimum diameter end of the changing torque arm portions of the capstan in order to attain maximum turn around efficiency at each turn of the pumping stroke.

In FIG. 1 there is shown a portable embodiment of the pumping apparatus of the invention which uses a single cable 21 having one end 21*a* which extends from a capstan drum 23 down an oil well 25 and a second end 21*b* which extends down a counterweight well 27 in which there is a counterweight, not shown. The capstan drum 23 is mounted on a rotatable shaft 29 journaled in bearings 31 on mounting brackets 33 and extends at one end into a reduction gear housing 35. The mounting brackets 33 and the reduction gear housing are all mounted upon a structural base 37 comprised of a series of longitudinal structural members 39 and transverse structural cross members 41. The gear reduction housing 35 and a prime mover or motor 43 which drives the reducing gearing via a belt drive within a belt housing 45 are all mounted on an additional base mounting structure supported upon the cross pieces 41 and longitudinal members 39. A pair of hydraulically and manually operated brake shoes 47*a* and 47*b* operate upon a shaft 49 which protrudes from the reduction gear housing 35. The brake shoes are operated either by the hydraulic cylinder 51 or the manual brake lever 53. The entire structure is movably mounted on rollers 55 which may be brought into contact with the ground by being rotated about pivots 56*a* by the action of set screws 56*b*.

The well side or end 21*a* of the cable 21 is wrapped several times about a constant diameter section 57 of the capstan drum 23 and passes directly into the well 25 past a guide sheave 59 mounted for rotation transverse of the rotation of the capstan. The counterweight end 21*b* of the cable passes from a variable diameter section 60 of the capstan 23 over a guide sheave 61 mounted for rotation parallel with the rotation of the capstan and into the counterweight well 27. The variable diameter counterweight section 60 of the capstan 23 is composed of a central constant diameter portion 63, a decreasing diameter spiral portion 65 and increasing diameter spiral portion 67 which merges with a constant diameter portion 69 equal in diameter to the greatest or maximum diameter of the increasing spiral portion 67 of the capstan 23.

Referring to FIG. 2, the various contours of the constant diameter pumping strand section 57, the constant diameter portion 63 of the counterweight section 60, and the decreasing spiral portion 65 and increasing spiral portion 67, as well as the preferred maximum constant diameter portion 69 of the counterweight section of the capstan can be readily seen as well as the portion 57*a* of the pumping strand section 57 of the capstan, which portion 57*a* doubles in this embodiment as both a portion of the pumping strand section of the capstan and the minimum constant diameter portion of the counterweight section of the capstan.

During operation of the apparatus shown in FIGS. 1 and 2 the motor 43 operates as the result of suitable limit switches or other control means keyed to the number of revolutions of the capstan only during the time the counterweight cable 21*b* passes from the constant diameter portion of the variable portion of the variable diameter counterweight section of the capstan 23. One suitable arrangement for controlling the motor is shown by way of example in FIGS. 15 and 16 described hereinafter.

Assuming that the capstan is part way through the upstroke of the pumping apparatus with the motor operating, when the capstan has rotated sufficiently so that the counterweight cable is just about to enter the decreasing spiral diameter portion of the capstan, the limit switches or control mechanism will switch off the motor 43. The capstan, reducing gearing, and motor will continue to coast, gradually slowing down as the counterweight cable passes from progressively smaller diameter portions of the capstan. When the torque arm of the counterweight portion of the cable upon the capstan become short enough so that the effective weight of the pumping string is sufficient to overbalance the effective weight of the counterbalance, the capstan and pumping stroke will reverse and the pump string will begin to descend in the well, lifting the now effectively lighter counterweight. Since the momentum of the apparatus will have carried the pumping string a little beyond the actual overbalancing point, the counterweight cable will have passed partially onto the constant diameter portion or section 57*a* of the capstan 23, which section doubled both on the constant diameter well cable section 57 and the constant diameter portion 57*a* equal to the minimum diameter of the decreasing spiral portion of the variable diameter counterweight section of the capstan. Thus when the pumping stroke is finally turned around by the overbalancing of the weight of the well string and the capstan begins to rotate in the opposite direction, the counterweight cable will not immediately begin to pass from progressively increasing diameter sections of the so-called decreasing diameter portion 65 of the variable counterweight section 60 of capstan. The cable will instead initially pass only from a minimum constant diameter portion 57*a* of the capstan, thus maintaining the minimum effective lever arm on the counterweight cable and maintaining a constant torque on the capstan for the initial portion of the pumping stroke, and allowing the maximum overbalancing force of the pumping string to rapidly accelerate the pumping stroke during the initial portions of the pumping stroke. It will be understood, of coure, that the relative weight of the counterweight with respect to the pumping string will be proportioned so that when the cable to each extends from the same or similar diameter portions of the capstan drum, i.e. the section 57 and portion 57*a* of section 57, and thus have equal effective lever arms, the weight of the pump string will be sufficient to significantly overbalance the weight of the counterbalance.

When the counterweight cable has wrapped itself completely about, and thus passed completely from, the constant diameter portion 57*a* of the section 57 of the capstan, during which time the counterweight has had a minimum effective lever arm, the counterweight cable begins to wrap about the so-designated decreasing spiral portion 65 of the counterweight section 60 of the capstan. As the cable wraps about this portion of the capstan in the upward direction of the effective lever arm of the counterweight increases slowly, but does not increase sufficiently to overbalance the weight of the pump string. The increasing downward acceleration of the pumping string is, however, gradually decreased by the increasing relative effective weight of the counterweight. When the counterweight cable has wrapped completely about the so-designated decreasing spiral portion 65 of the counterweight section 60 of the capstan and begins to wrap about the constant diameter central portion 63 of the counterweight section 60 of the capstan, the downward acceleration of the pumping string has been substantially arrested, but the pumping string is still moving rapidly downward. At this point, or shortly before as the counterweight cable is just completing its wrapping upon the so-designated decreasing diameter portion 65 of the capstan, the motor 43 is activated in the direction in which the capstan is moving. Preferably the motor will be of a type which will rotate with equal feasibility in whatever direction it is initially started by an applied torque. Alternatively, however, the polarity of the motor may be switched depending upon what direction it is desired that it rotate. The operation of the motor increases the acceleration of the pump string in the downward direction and serves to lift the counterweight at a time when the effective weight of the pumping string is no longer sufficient to provide even movement downwardly. In other words, the operation of the motor effectively relieves the pumping string from the overbalancing weight of the counterweight. The pumping downstroke is thus allowed to continue smoothly downward. The motor is activated when the movement of the pumping string is already moving smoothly so that a minimum starting strain is placed on the motor. The motor operates during the time when the counterweight cable extends from the constant diameter portion 63 of the counterweight section 60 of the capstan so that the operation of the motor is not interfered with by an increasing counterweight load.

When the counterweight cable has completely wrapped about the constant diameter portion 63 of the counterweight section of the capstan and is about to begin wrapping about the increasing spiral portion 67 of the counterweight section, the motor is deactivated. As the counterweight cable then wraps about the increasing spiral portion 67 of the counterweight section 60, the efffective lever arm of the counterweight progressively increases until the effective weight of the counterweight overbalances the weight of the pump string and the pumping stroke reverses. Because of the downward momentum of the pump string, the pumping stroke will not reverse at the exact moment when the effective weight of the counterweight becomes greater than the weight of the pumping string. Instead the counterweight cable will continue to wrap upon the maximum constant diameter portion 69 of the capstan which extends adjacent to the maximum diameter of the increasing diameter spiral portion 67 of the counterweight section 60 of the capstan. It will, of course, be understood that the maximum diameter of the increasing spiral portion 67 of the counterweight section of the capstan will be dimensioned such that the effective lever arm of the counterweight at the maximum diameter of the capstan will be sufficient to overbalance the pumping string and provide a satisfactory rate of downward movement of the downstroke when the counterweight cable extends from the maximum diameter portion. Thus after the counterweight cable reaches the maximum diameter of the capstan and begins to wrap upon the preferred constant maximum diameter portion 69 of the counterweight section of the capstan, the overbalancing effect of the counterweight will quickly decelerate the downstroke of the pumping apparatus to a stop and then reverse the pumping cycle to the upstroke mode as the counterweight descends in the counterweight well, hoisting the pumping string, pump and the oil contained in the well tubing. The effective lever arm of the counterweight is at first maintained constant as the counterweight cable unwinds from the constant maximum diameter portion 69 of the counterweight section 60 of the capstan. A maximum counterbalancing effect is thus maintained at the beginning of the pump upstroke to attain a maximum acceleration of the pumping string and pump upwardly during the initial portions of the upstroke of the pumping cycle. It will also be understood that during all the time the counterweight cable is wrapping upon various diameters of the capstan the pump or well end of the cable will be unwinding from the grooves of the single constant diameter well section of the capstan.

When the counterweight cable has completely unwrapped from the constant maximum diameter portion 69 of the counterweight section 60 of the capstan during the period when the maximum counterweight force is applied, the counterweight cable begins to unwrap from the increasing diameter spiral portion 67 of the counterweight section 60 of the capstan. The effective lever arm of the counterweight thus decreases and the effective overbalancing of the pump string by the counterweight progressively decreases. However, the lever arm of the counterweight remains sufficient to continue to overbalance and raise the pump string.

When the counterweight cable has completely unwrapped from the increasing diameter portion 67 of the counterbalance section 60 of the capstan, or shortly before the cable has completely unwrapped, the motor 43 is activated. The motor serves to lift the pump string and associated pump plus the oil contained in the well tubing, partially or completely relieving the weight of the pump string from the counterweight. As on the downstroke, the motor is activated only after the upward movement of the pump string has become stabilized or steady and the motor remains activated while the counterweight cable is unwinding or unwrapping from the central constant diameter portion 64 of the counterweight section 60 of the capstan. Since the motor is preferably rotated through the reduction gearing by the rotation of the capstan even when the motor is not activated, when the motor is activated the motor begins operation with minimum shock loading. Furthermore, since the motor operates during the time that the counterweight cable as well as the pumping cable extends from a constant diameter portion or section of the capstan, the operation of the motor is not opposed by any change in the relative effect weights of the counterweight and the pumping string. The motor thus operates during its entire activation period with a minimum wastage of energy.

When the counterweight cable has completely unwrapped from the central constant diameter portion 63 and is about to being unwinding from the decreasing spiral portion 65 of the counterweight section 60 of the capstan, the motor is deactivated. As the counterweight cable then unwraps from the decreasing spiral portion 65 of the counterweight portion of the capstan, the effective layer or torque arm through which the counterweight exerts its weight or force as a torque upon the capstan progressively decreases until the effective weight of the counterweight no longer overbalances the pumping string, at which point the counterweight cable will begin unwinding from the minimum diameter portion 57*a* of the counterweight section of the capstan (which is coextensive in the embodiment shown with the pumping cable section 57 of the capstan). This unwrapping of the cable continues until the momentum of the upward pumping stroke is dissipated and the pumping stroke is turned around or reversed by the greater effective weight of the pumping string. The pumping cycle then continues as described above.

In FIGS. 3 and 4 there are shown respectively an elevation and a plan view of a further embodiment of a pumping apparatus in accordance with the invention. This pumping apparatus uses a single rotating capstan and two separate cables, a counterweight cable and a well cable. As in the embodiment shown in the previous FIGURES the capstan of the embodiment shown in FIGS. 3 and 4 has a constant diameter section from which the well cable extends and a variable diameter section from which the counterweight cable extends. The variable counterweight section includes the same constant diameter portion, and increasing and decreasing diameter spiral portions, which are used in the previous embodiments shown in FIGS. 1 and 2, but the positioning of these portions with respect to the constant diameter well cable section of the capstan is somewhat different in order to accommodate two separate well cables. The two cables are attached to the capstan at opposite longitudinal ends of the capstan and extend or wrap in opposite directions about the capstan in the grooves upon its surface.

As in the previous embodiment, the apparatus shown in FIGS. 3 and 4 is mounted upon a structural base 101 which is comprised of longitudinal beam members 103 and transverse beam members 105. Upon the structural base there is mounted a reduction gear housing 107 containing a suitable reduction gear. A capstan 109 is attached to a shaft 110 which extends through the reduction gear housing and engages the gears within the housing. A motor 111 is also mounted upon the structural base and operatively connected by a drive belt means 113 and two sheave means **114*a* and 114*b* connected respectively to the shaft of the motor 111 and to a gear reduction drive shaft 116 which is also meshed with the reduction gear means within the reduction gear housing 107. Brake shoes 115*a* and 115*b* are positioned to surround a brake drum 117 mounted upon the opposite end of the gear reduction drive shaft 116. A manually operated brake lever 119 is provided to operate the brake shoes 115*a* and 115*b* via a brake linkage 121. A hydraulic cylinder 120** is also provided to operate the brake shoes automatically when desired through any suitable automatic control means.

An inclined structural post 123 braced by a vertical structural post **123*a* is provided on the top of the mounting base 101 at the well side of the base and a second inclined structural post 125 supported by vertical structural post 125*a* is mounted upon the opposite counterweight well side of the mounting base. A large diameter well cable guide sheave 127 is rotatably journaled in bearings 131 provided at the upper end of the structural post 123, while a large counterweight cable guide sheave 129 is rotatably journaled in bearings 133 positioned at the top of the structural post 125. A well cable 135 extends from the capstan 109 over the well cable guide sheave 127 and into the top of an oil well 141. Likewise a counterweight cable 137 extends from the capstan 109 about the counterweight cable guide sheave 129 and then into the top of a counterweight well 139**.

In FIG. 5 there is shown a schematic diagram of the pumping apparatus shown in FIGS. 3 and 4. The pumping apparatus is shown operatively positioned between an oil well 141 and a counterweight well 139 as in FIGS. 3 and 4. In FIG. 5, in addition to the parts of the apparatus already described in connection with FIGS. 3 and 4, which parts are schematically shown in FIG. 5 and identified with the same numbers as used in FIGS. 3 and 4, there is additionally shown a well casing **141*a* extending into the ground. There is also shown a counterweight 143 attached to the end of the counterweight cable 137 and supported on the end of the cable 137 in the counterweight well 139. Additional removable counterweight plates 143*a* are shown superimposed or supported upon the counterweight 143. Within the well casing 141*a* there is also shown the usual well tubing 145 and within the upper portions of the well tubing 145 there is shown a polished pipe 146 within which a so-called traveling stuffing box 147 is positioned for reciprocal up and down movement. Details of the traveling stuffing box shown in FIG. 5 are more fully shown in U.S. Pat. No. 3,640,342 issued to the present inventor on Feb. 8, 1972. The well cable 135 passes down through the well head 140 and is attached through a suitable coupling to the top of the traveling stuffing box 147 and the usual series of sucker rods 149** are attached to and extend from the lower portion of the traveling stuffing box down the well within the well tubing and well casing to the usual down-hole pump, not shown.

In FIG. 6 there is shown an elevation of the capstan drum shown in FIGS. 3, 4 and 5. The elevation shown in FIG. 6 may be readily compared with the elevation of the embodiment of the capstan shown in FIG. 2. FIG. 7 is an end view of the capstan shown in FIG. 6 particularly illustrating the raised central cam portion of this embodiment. The capstan is shown in FIG. 7 as an open rim structure in order to show the relationship of the parts most clearly.

The capstan 109 shown in FIGS. 3, 4, 5, and particularly as illustrated FIGS. 6 and 7, is comprised of basically the same constant diameter sections and changing diameter sections as the previous embodiments shown in FIGS. 1 and 2, although the arrangement of the various portions and sections of the capstan with respect to each other are somewhat different from that shown in FIGS. 1 and 2 in order to accommodate the two separate cables which extend from the capstan in the embodiment shown in FIGS. 3, 4, 5, 6 and 7. In particular the well cable and counterweight cable sections of the capstan are arranged differently with respect to each other. In order to more clearly indicate the relationship between the various sections and portions of the capstans in the two embodiments, the various sections and portions of the capstan of the embodiment shown in FIGS. 3, 4, 5, 6 and 7 have been given the same designating numbers raised by 100 as the sections and portions of the capstan embodiment shown in FIGS. 1 and 2. In other words, the constant diameter well cable section of the capstan 109 of the embodiment shown in FIGS. 3 through 7 has been designated as 157 in parallel with the designation of the same constant diameter well cable section 57 of the capstan of the pumping apparatus shown in FIGS. 1 and 2. Likewise there is shown, particularly in FIG. 6, a constant diameter portion 163 of the counterweight cable section 160 of the capstan 109. Likewise there is shown a decreasing diameter spiral portion 165 of the variable counterweight section of the counterweight section 160 of the capstan 109 and an increasing diameter spiral portion 167 of the counterweight section 160, shown most clearly in FIG. 7. There is also a maximum diameter cam portion 169, shown most clearly in FIG. 7, corresponding generally to the largest diameter of the increasing spiral portion 167 of the counterweight section of the capstan 109.

In addition spirally increasing portion 169*a* is provided on the capstan 109 which is not found on the capstan drum 23 shown in FIGS. 1 and 2. This spiral increasing section 169*a* leads from constant diameter well cable section 57 to the upper portion of the maximum diameter cam portion 169. This portion 169*a* of the capstan 109 provides a special pump-up cam function during certain portions of some pumping cycles. The well cable can ride up this cam section at these times in order to obtain a greater effective torque arm upon the capstan from the well cable or pumping string as will be more fully described hereinafter.

As shown illustrated in FIGS. 3 and 7 the cam portion 169 of the capstan has a center which is displaced a few inches toward the edge of the cam from the axis of rotation of the capstan. The cam section is thus eccentric with respect to the axis of rotation of the capstan and continues to increase in effective diameter toward the middle edge of the cam. However, the spiral portions 167 and 169*a* leading into the eccentric cam portions provide the principle amount of change in cam section. Because of the eccentric cam configuration the maximum diameter of this portion of the capstan is not on a constant diameter portion, but rather occurs at the outer edge of an increasing cam section. It will be understood, however, that an actual constant diameter configuration could be used. The arrangement illustrated has the advantage of providing a constantly increasing cam section upon which the well cable in particular can ride if a normal turn around is not effected at the top of the stroke, as described in more detail hereinafter. Briefly when the cable rides up upon the cam the torque arm of the well cable upon the capstan will be increased sufficiently to effect a turnaround of the pumping cycle. Since the well cable will ride up onto the cam section only in those cases where insufficient torque is exerted by the normal torque arm on the constant diameter well cable section of the capstan, it is advantageous to provide a continuously increasing diameter for the cam so that an increasing torque arm will be provided until turnaround is finally effected.

It will be noted that the decreasing spiral portion of the counterweight section 160 of the capstan 109 is on the opposite end of the capstan from the constant diameter well cable section 157 of the capstan, whereas in the capstan of the embodiment of the invention shown in FIGS. 1 and 2 the decreasing spiral portion of the counterweight section of the capstan is positioned adjacent to the constant diameter section of the constant diameter well cable section of the capstan. This difference is due basically to the fact that in the embodiment shown in FIGS. 3, 4, 5, 6 and 7, two separate cables are used for the counterweight cable and the well cable and these two cables are attached to the extreme outer portions of the capstan by any suitable clamp arrangement and extend in opposite directions about the capstan so that they extend as a wrap upon the capstan towards each other rather than away from each other. The second difference in the two embodiments of the capstan is that in the capstan shown in FIGS. 3, 4, 5, 6 and 7, the increasing spiral portion 167 of the counterweight section 160 constitutes only an arc rather than a full circumference of the capstan. Likewise, the preferred maximum diameter cam portion 169 of the counterweight section 160 of the capstan 109 constitutes only an arc rather than a full circumference of the capstan. Furthermore, a so-called pump-up spiral cam portion 169*a* is provided leading from the constant diameter well cable section 157 in a spiral arc which merges into the maximum diameter cam portion 169 of the counterweight section 160 of the capstan 109. Thus it will be seen that in the embodiment invention shown in FIGS. 3, 4, 5, 6 and 7 there is in the center of the capstan an enlarged grooved section or portion which is comprised essentially of a single slowly increasing eccentric cam having a spiraled-up arc portion at both ends which spiraled-up grooved portions connect the enlarged central arc section with the adjacent constant diameter portions of the capstan.

The operation of the pumping apparatus shown in FIGS. 3, 4, 5, 6 and 7 is substantially the same as the operation of the embodiment of the invention shown in FIGS. 1 and 2 and the operation will thus be summarized only, except for the operation of the pump-up cam 169*a* and 169. Briefly, during operation the motor 111 is activated during the time that the counterweight cable 137 extends from the constant diameter section portion 163 of the counterweight section 160 of the capstan 109. That is to say, the motor 111 is operated only during that time when the counterweight cable is either wrapping itself about or unwrapping itself from the constant diameter portion 163 of the capstan. There is an exception to this statement in some cases in that the motor may be activated during both the upstroke and downstroke of the pumping apparatus just before the counterweight cable reaches the constant diameter section 163 of the counterweight section 160 of the capstan, i.e. when the cable is either nearly finished winding upon the decreasing diameter portion 165 or nearly finished unwinding from the increasing diameter portion 167 of the counterbalance section 160 of the capstan. Likewise the turn-around at each end of the pumping stroke is effected without any outside power input merely by changing the effective lever or torque arm of the counterweight upon the capstan by arranging for the counterweight cable to extend at the bottom of the pumping stroke from the maximum diameter cam portion 169 positioned at the top of the increasing diameter spiral portion 167 of the counterweight section 160 of the capstan, and by having the counterweight cable extend from the minimum diameter portion 157*a* of the counterweightsection 160 of the capstan at the top of the pumping stroke. The pumping cable or well cable 135 ordinarily will remain upon the constant diameter section 157 of the capstan during normal operation. However, in the event that the well string should be lighter than normal, for example, during pump-up of the apparatus when the well tubing is not full of oil well fluid, the pumping stroke will travel slightly farther on the upstroke and the well cable will ride up upon the pumping strand pump-up spiral cam portion 169*a* and onto the eccentric cam portion 169. This effectively increases the lever-arm of the pumping strand at the very top of the stroke so that the pumping strand and associated downhole well apparatus is effectively heavy enough to overbalance the counterweight. If the well string is only a little light, the cable may ride only up onto the spirally increasing cam portion 169*a* before turnaround occurs, but if the relative weight of the pumping string is even less the cable will ride farther up onto the eccentric cam portion 169 as far as necessary to effect turnaround of the pumping stroke.

In FIG. 7 there is shown an end view of the capstan showing the combined increasing diameter spiral portion 167, constant eccentric cam portion 169 and the pumping strand spiral pump-up cam portion 169*a*. It will be readily seen that each of these sections or portions 167, 169 and 169*a* of the capstan extends over merely an arc rather than a complete circumference of the capstan and the increasing spiral portions 167 and 169*a* constitute the ends or lead-in portions to the eccentric cam central portion 169.

It is preferred that the ends of the capstan at the points where the respective cables are attached shall be spiraled fairly sharply inwardly in order to change the angle of the cable upon the surface of the capstan and increase the holding power of the clamps which hold or secure the cable to the capstan surface. These spiraled down portions or depressions upon the surface of the capstan at the point of attachment of the cable to the capstan also serve to assure that the cable will lie smoothly about the capstan and that if a section of the cable which is wrapped about the capstan should escape from a groove upon the capstan surface it will not become entagled with the cable clamps which secure the cable to the ends of the capstan. This spiraling down at the end of the capstan is shown in the FIGURES and particularly in the plan view, FIG. 4, of the invention where a depression on the extreme end of the capstan will be noted. It should be understood that this depression, or so-called dead end, at the end of the capstan will constitute only a small arc or portion of the surface of the capstan.

Figure 9:
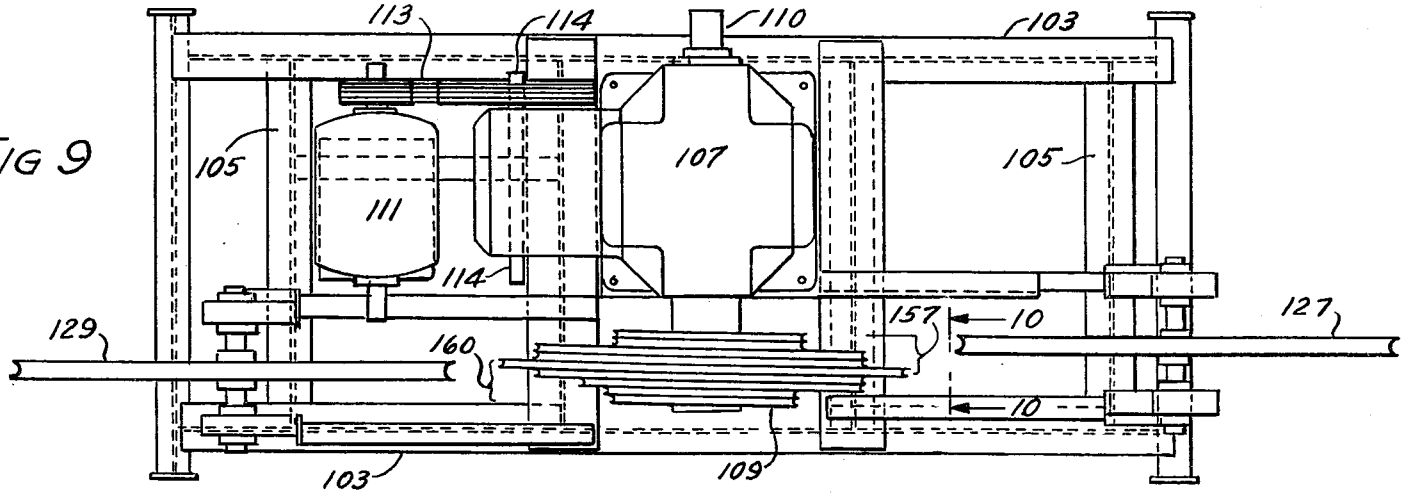
FIG. 9 is a plan view of the apparatus of FIG. 8.
Figure 8:
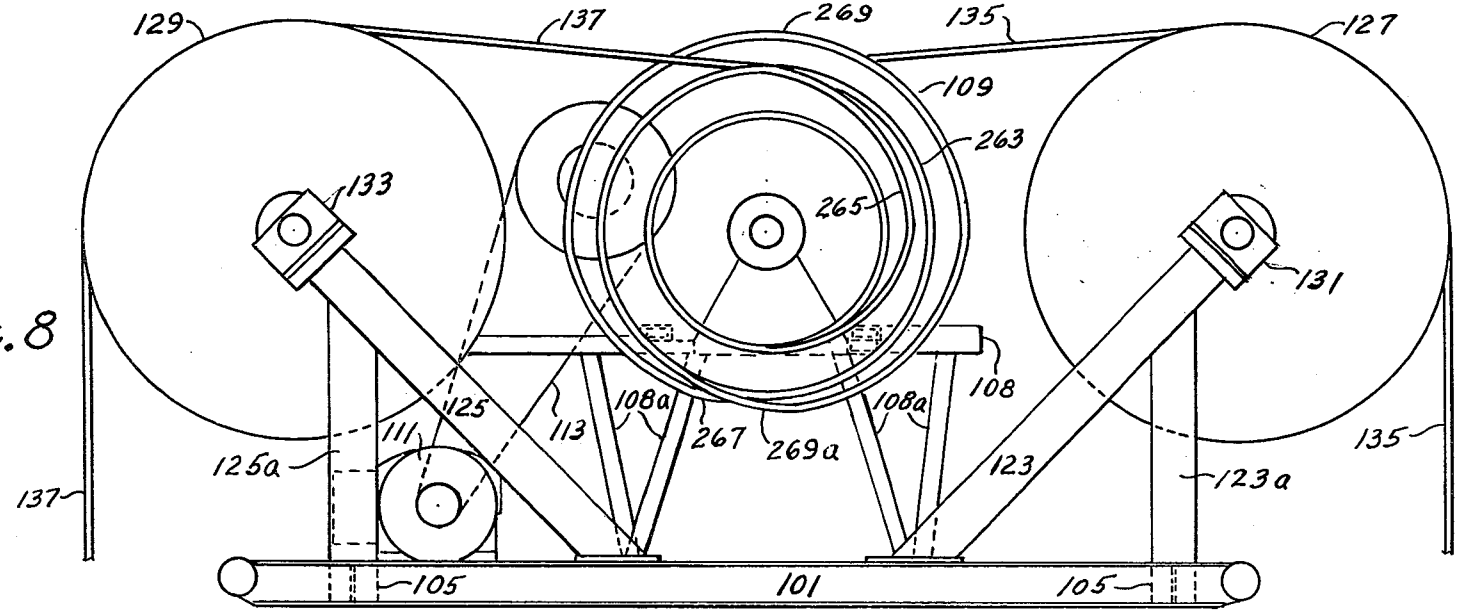
FIG. 8 is an elevation of a further preferred embodiment of a long stroke pumping apparatus in accordance with the invention.

In FIGS. 8 and 9 there is shown a still further embodiment of the invention wherein the capstan is additionally provided adjacent the constant diameter well cable section of the capstan with a decreasing spiral portion which operates tógether with the increasing spiral section portion of the counterweight section of the capstan to effect a smooth and rapid turnaround at the end of the upstroke. The well cable is in this embodiment also designed to ride up upon an increasing spiral portion at the end of the constant diameter well cable section to cooperate on every normal stroke of the pumping apparatus with the decreasing diameter portion of the counterweight section of the capstan to assure a smooth even turnaround at the top of the pumping stroke. This increasing spiral portion of the well cable section of the pumping capstan is constructed substantially in the same manner as the spiral pump-up cam section of the embodiment of the invention shown in FIGS. 3, 4, 5, 6 and 7.

The design and construction of the embodiment of pumping apparatus shown in FIGS. 8 and 9 is substantially similar to the design and construction of the pumping apparatus shown in FIGS. 3 and 4. Consequently, the same designating numerals have been used to indicate similar structures and arrangements.

Figure 10:
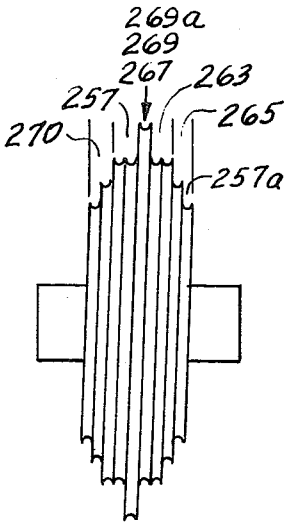
FIG. 10 is a view of the capstan of the pumping apparatus taken along lines 10—10 of FIG. 9.

Thus in FIGS. 8 and 9 there is a mounting base 101 constructed of longitudinal structural members 103 and transverse structural members 105. A reduction gear housing 107 is mounted on a mounting platform 108 supported on mounting brackets 108*a* at the center of the mounting base 101. A capstan 109 is mounted on a rotatable shaft 110 which extends through the reduction gear housing 107. The reduction gearing within the housing is driven by a motor 111 through a belt drive 113 which turns a drive shaft 114 in the reduction gear mechanism. The two large guide sheaves 127 and 129 are rotatably journaled in bearings 131 and 133 respectively upon structural posts 123 and 123*a* and 125 and 125*a* on opposite ends of the apparatus. The well cable 135 extends from a constant diameter section 157 of the capstan over the guide sheave 127 and down a well not shown. Likewise a counterweight cable 137 extends from the counterweight section 160 of the capstan 109 into a counterweight well, also not shown. Referring to FIG. 10, the capstan of the embodiment shown in FIGS. 8 and 9 is comprised essentially of a constant diameter well cable section 257 and constant diameter counterweight section 63, decreasing diameter spiral well cable portion 270 and a decreasing diameter spiral counterweight section 265. Between the two constant diameter sections 257 and 263 there is positioned a cam having a concentric constant diameter portion 269 and two increasing diameter spiral arc sections 267 and 269*a*, one of which increasing diameter sections serves as an increasing spiral portion 269*a* of the well cable section of the capstan and the other of which increasing diameter portions serves as an increasing spiral portion 267 for the counterweight section of the capstan. It will be understood that the operation of this capstan is substantially similar to the operation of the previously shown capstans with the exception that the increasing diameter spiral portions of both the well cable section and the counterweight section of the capstan are coordinated with the decreasing spiral portions of the counterweight section and the well cable section of the capstan respectively to attain a cooperative relationship between the actions of the lever or torque arms at the turnaround at each end of the pumping stroke. In other words, the difference in effective lever arms between the well cable and the counterweight cables is determined not merely by the changing lever arm of the counterweight, but by the interaction of a changing counterweight lever arm and an oppositely changing well or pump string lever arm. As in the previous embodiments, the motor is operated substantially only during that portion of the time when the two cables, i.e. the pumping string cable and the counterweight cable, extend from the constant diameter sectons of the capstan. It should be noted that the largest diameter portion 269 of the capstan is in this embodiment a concentric constant diameter arc rather than an eccentric progressively increasing cam section. If desired, this largest diameter portion could be comprised of an eccentric cam arrangement as in the previous embodiment, however.

Figure 12:
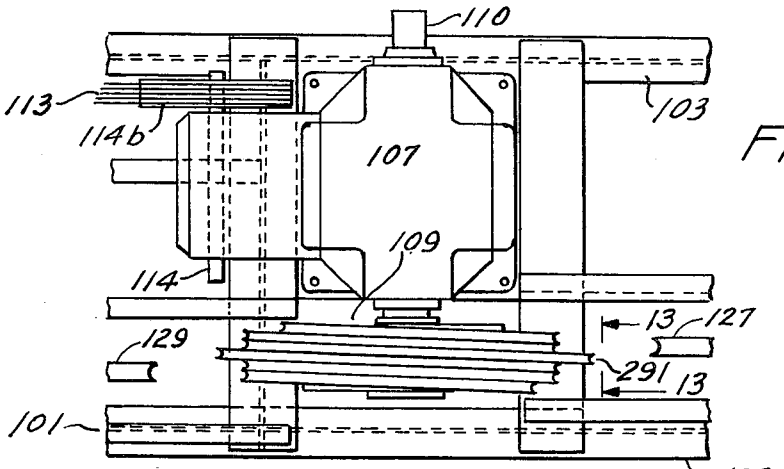
FIG. 12 is a top view of the capstan and some of the associated apparatus shown in FIG. 11.
Figure 11:
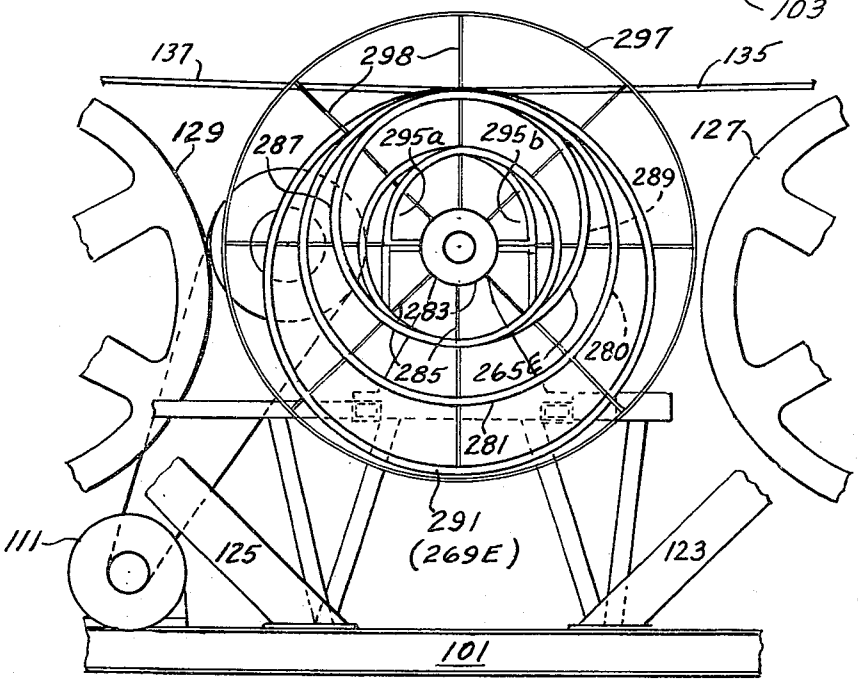
FIG. 11 is an elevation of a further embodiment of the capstan of the invention.

An improved and preferred capstan arrangement is shown in elevation and plan view respectively in FIGS. 11 and 12. In these FIGURES all of the pumping apparatus is essentially the same as that shown in FIGS. 8 and 9 except for the capstan construction. Only a portion of the apparatus about the capstan is shown therefore and the same identifying numerals are used for similar structures and apparatus in FIGS. 11 and 12 as are used in FIGS. 8 and 9.

Figure 13:
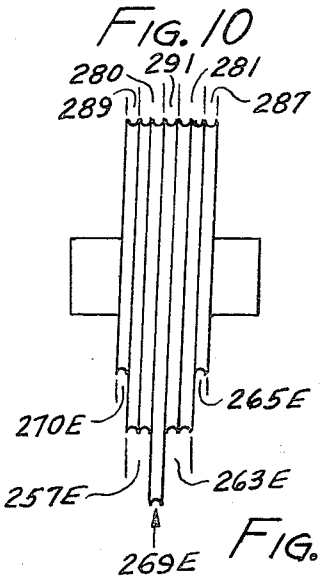
FIG. 13 is a view of eccentric cam type capstan of FIGS. 11 and 12 taken along lines 13—13 of FIG. 12.

The capstan shown in FIGS. 11 and 12, while basically similar in design to the previously illustrated embodiments, has a quite dissimilar construction. An elevation of the capstan is shown in FIG. 13 to aid in understanding of its construction. The capstan sections which are in FIG. 13 designated with the same numerals plus in each case the designation "E" (for eccentric), as the capstan shown in lengthwise elevation in FIG. 10 is constructed with the same constant diameter well cable section 257E and contant diameter counterweight cable portion 263E, effectively decreasing diameter counterweight portion 265E and effectively decreasing diameter well cable portion 270E. Between the two constant diameter section 257E and 263E there is positioned an effectively increasing diameter cam section 269E which serves as a common central increasing diameter portion for both the well cable section and the counterweight section of the capstan.

In the capstan shown in FIGS. 11 and 12 the constant diameter portions 257E and 263E of the well cable portion and the counterweight portion respectively of the capstan are constructed preferably of circular constant diameter outer rims 280 and 281 respectively which are supported concentrically with respect to the hub 283 of the capstan by spoke members 285. The portions 265E and 270E of the capstan are comprised also of constant diameter rims 287 and 289, which are, however, smaller than the rims 280 and 281. The small rims 287 and 289 are mounted eccentrically with respect to the hub 283 of the capstan upon spoke members 285 with one portion of the surface of the rim 287 tangent to the surface of rim 281 and one portion of the surface of the rim 289 tangent to the surface of the rim 280.

The large diameter central cam portion 269E of the capstan is composed of a large diameter rim 291 which is also eccentrically mounted with respect to the central hub 283 of the capstan. The eccentric mounting of the large rim 291 is such that the surface of this large rim is tangent to the surfaces of both the adjoining constant diameter well cable rim 280 and the adjoining constant diameter counterweight cable rim 281 and is also tangent to the surface of the smaller diameter rims 287 and 289. Thus all the rims are positioned with their surfaces tangent at one point with each other. The surfaces of the rims are grooved and the grooves of the various rims interconnect with the grooves of adjacent rims so that a cable wrapping upon or unwrapping from the surface of the rims may pass easily from one rim section to an adjacent rim section. The eccentrically mounted rims may be considered to comprise essentially cam sections or portions of the capstan which effectively either increase or decrease in diameter for one-half circumference of the capstan.

The large diameter rim 291, or large cam, will preferably be reinforced with plate 293 and this same type of reinforcement may also be used to make the smaller rims more rigid. At the outer ends of the smaller rims 287 and 289 there are provided grooved deadends 295*a* and 295*b* which spiral inwardly from the small diameter rims 287 and 289 respectively just beyond the minimum torque point and are adapted to be provided with cable clamps, not shown which secure the respective cables 137 and 135 to the capstans. The deadends are designed to snub the ends of the cable only and not to exert any torque arm upon the capstan. Thus the cables always lie in the grooves of the deadends and do not extend tangentially from the deadends at any time.

Cable retaining rings 297 are supported upon brackets 298 at the outer edges of the capstan and spaced from the operative body components, i.e. the grooved rims and associated structures, to keep the cable from becoming displaced from the edges of the capstan rims.

The axis of rotation of the entire capstan is through the center of the hub 283 of the capstan. Since the constant diameter well cable section 257E constituted by the rim 280 and the constant diameter counterweight portion 263E constituted by the rim 281 are positioned concentrically about the hub it follows that the surfaces of these constant diameter sections 257E and 263E rotate in a circle about the axis of rotation of the capstan. It also follows that since the large rim 291 and small rims 287 and 289, which are respectively larger and smaller than the rims 280 and 281, but which are all positioned tangent at one point upon their surfaces with the surface of the rims 280 and 281, must rotate eccentrically about the hub 283 during rotation of the capstan. The distance between the point of contact of the cable with the circumference of the capstan and the hub or axis of rotation of the capstan determines the normal torque arm applied by the cable to the capstan. This distance and consequently the torque arm is constant for the well cable and counterweight rims 280 and 281 at all points on their circumference. However, since the distance of the common central large rim 291 from the hub 283 progressively increases as one passes along the rim 291 in either direction from the tangent point, the torque arm applied by a cable extending from the surface of the rim, in a direction not extending through the axis of rotation, progressively increases as the cable extends from portions of the rim more and more distant from the tangent point and reaches a maximum at the opposite side of the rim from the tangent point. Likewise, since the distance from the hub 283 to the rim progressively decreases as one passes along either of the small rims 287 or 289 in either direction from the tangent point, the torque arm applied to the capstan by a cable extending from the surface of the rims — again in a direction which does not pass through the axis of rotation of the capstan, and preferably extends tangent with respect to the rim — progressively decreases as the cable extends from portions of the rim more and more distant from the point of tangency of the rims with each other and reaches a minimum at the opposite side of the rim from the tangent point. The large eccentric rim 291 may be descriptively called an up-cam, meaning an increasing cam section, while the small eccentric rims 287 and 289 may descriptively be called downcams, meaning descreasing cam sections.

The changing torque arm as one progresses along the rim of either the smaller or the larger rims can be easily varied depending upon the circumference of the rims selected. In every case, however, the changing torque will either increase or decrease geometrically as the cable progresses around the rim rather than increasing or decreasing linearly as in a constant diameter spiral section such as shown in FIGS. 1 through 10. The change in torque thus in each case begins very gradually as the cable passes at the tangent point from the constant diameter drums or rims 280 and 281 onto the increasing diameter cam, i.e. rim 291, or either of the decreasing diameter cams, i.e. rims 287 and 289, but then changes at a progressively more rapid rate with each increment of rotation of the capstan until the maximum or minimum torque arm is attained at the point opposite the point of tangency. This assures that any change in torque begins gradually, but increases rapidly, thus minimizing initial shock loadings, but ultimately maximizing the effect of any change in mechanical advantage.

It will also be advantageous in many cases to have a constant diameter section concentric with the axis of the capstan on the outside of the decreasing diameter sections 265E and 270E (rims 287 and 289), although this preferred refinement is not illustrated in FIGS. 11 and 12. These constant diameter concentric sections would be comprised of concentrically disposed grooved rims having a diameter equal to the shortest distance from the axis of rotation to the surface of the rims 287 and 289. The grooves of the additional constant diameter sections would interconnect with the grooves of the adjoining rims 287 and 289 and the grooves of the deadends 295*a* an 295*b* which would then be disposed on the outer side of the additional constant diameter section. The concentric constant diameter sections would be tangent with the rims 287 and 289 at the point of minimum distance between the axis of rotation and the grooved surface of the rims 287 and 289. As in the previous embodiments the preferred additional constant diameter section provides a constant minimum torque for a short time during the top and bottom of the pumping stroke.

If a constant minimum diameter rim section is used it will also then be advantageous to incorporate a constant maximum diameter common central grooved rim section concentric with the axis of rotation of the capstan. This common central section will have a radius equal to the longest distance between the axis of rotation and the edge of rim 291. In this arrangement there will also be two rims 291, one for the well cable on one side of the additional maximum constant diameter section, and one on the other side of the maximum constant diameter section with surface grooves leading from one section to the other. Such a preferred capstan will then be comprised of five different sized rims with a total of nine rims altogether, all arranged tangent to each other, but not at the same point. The central largest rim will be arranged concentric with the axis of rotation and will serve as a common maximum diameter section. On either side of this will be two smaller rims arranged eccentrically with the axis. These serve as the increasing diameter sections of the capstan. Next will come two still smaller rims arranged concentrically with the axis which rings provide the basic constant diameter sections of the capstan. Next there are two still smaller sections which are arranged eccentrically with the axis and serve as the decreasing sections of the capstan. Finally two still smaller sections will be arranged concentrically with the axis outwardly of the above sections. These sections are the smallest diameter sections and serve as explained above to increase the time when the smallest torque arm is effective. It will be understood, of course, that the usual deadends for the cable will also be provided outboard of these sections. The two outer small concentric sections and the large central concentric section will all be tangent to the adjoining eccentric cam sections at the opposite side of the capstan from the point of tangency of the eccentric cam sections with the two central concentric constant diameter sections.

The preferred maximum and minimum diameter sections are not included in the specific embodiment shown in FIGS. 11 and 12, but a subsequent idealized disclosure of the invention includes these sections. See, for example, FIG. 22 and the description pertaining thereto.

Operation of the cam type capstan arrangement shown in FIGS. 11 and 12 is shown and described with reference to FIGS. 14A, 14B and 14C which show respectively the disposition of the capstan at one end of a pumping stroke, at the middle of a stroke and at the other end of a pumping stroke.

Figure 14A:
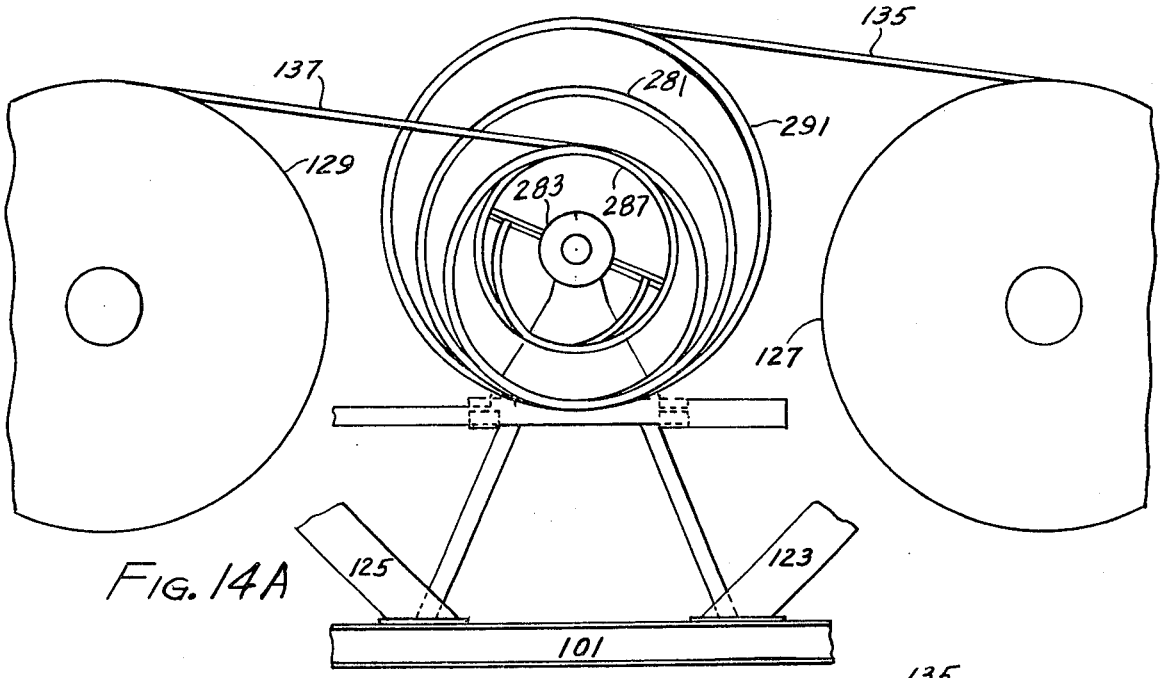
FIGS. 14A, 14B and 14C illustrate the operation of the capstan arrangement shown in FIGS. 11, 12 and 13, each figure illustrating the position of the capstan during a different part of the overall pumping stroke.
Figure 14B:
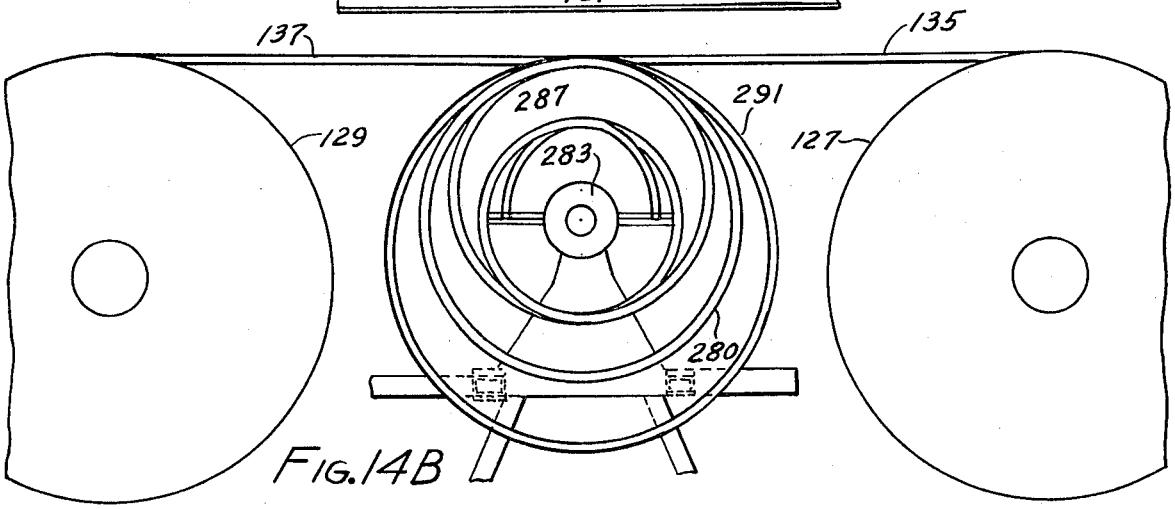
Figure 14C:
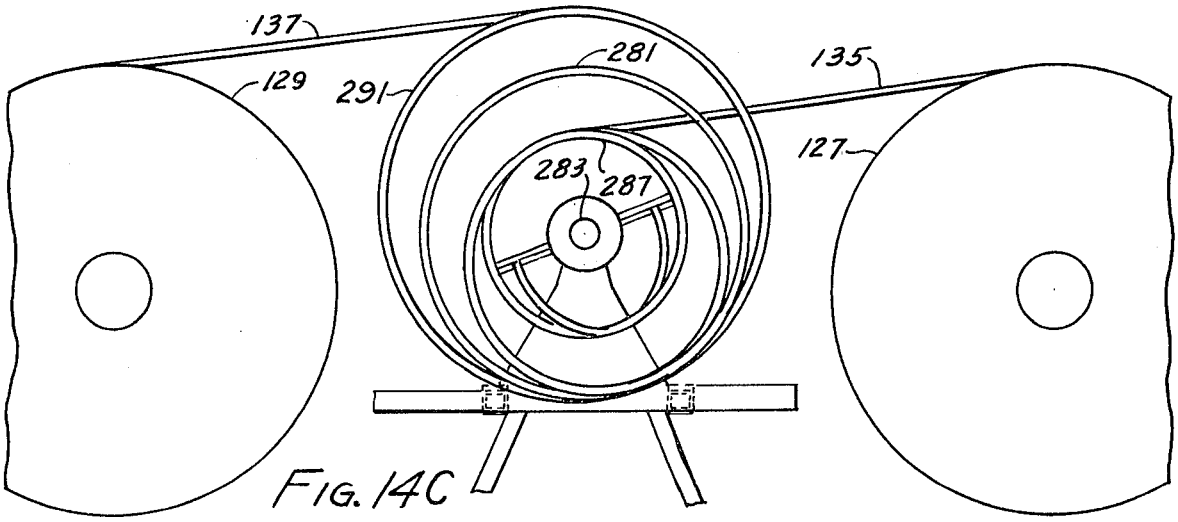

In FIG. 14A there is shown the disposition of the capstan at the top of the pumping stroke. The well cable 135 is seen extending from near the top of the large rim section 291 close to the point of maximum distance between the hub 283 and the edge of the rim. Likewise the counterweight cable 137 is shown extending from near the top of the small rim section 287 close to the point of minimum distance between the hub 283 of the capstan and the edge of the rim. It will readily be seen that the maximum torque arm is being applied to the capstan by the well cable 135. Consequently the capstan will begin turning counterclockwise, unwrapping the well cable 135 from the rim 291 and wrapping the counterweight cable about the rim 287. When the tangent point of the capstan reaches the top of the capstan as shown in FIG. 13B the torque arm applied to the capstan by both well cables will be the same. At this point, or shortly before, the motor is activated by suitable contact switches or other control devices and the motor will pick up the load and rotate the capstan counterclockwise for about two rotations. After about two revolutions the well cable will begin to unwrap from about the small diameter well cable rim 289 and the counterweight cable will begin to wrap upon the common large rim 291. Just before this takes place the motor will be deactivated by suitable contacts or other control devices. As the counterweight cable then winds onto the large cam and the well cable continues to unwrap from the small cam the torque applied to the capstan by the counterweight progressively increases and the torque applied to the capstan by the well cable progressively decreases until near the bottom of the downstroke there is sufficient overbalancing by the counterbalance to turn around the pumping stroke and the pumping apparatus then begins its upstroke. The position of the capstan and cables as the bottom of the downstroke is shown in FIG. 14C.

If the preferred constant diameter concentric minimum and maximum rim sections were used, the maximum and minimum dimensions of the up cam and down cam sections of the capstan would be dimensioned so that the momentum of the pump stroke would carry the stroke somewhat beyond the extreme dimensions of the cam sections and the respective cables would pass onto the constant diameter sections at each end of the pump stroke. After the apparatus then coasted to a stop the maximum return torque would be maintained during the initial portion of the turn-around of the stroke before it begins to decrease. Additional smoothness and maximum turn-around efficiency would then be obtained.

A number of devices can be used to activate and deactivate the prime mover or motor of the pumping apparatus at the proper time and in the proper sequence. One skilled in the art will readily be able to design several versions of such apparatus, however. One simple yet effective contact switch device is shown in FIGS. 15 and 16. This device can be readily attached to one end of the capstan shaft in the embodiments of the apparatus shown in any of the previous FIGURES. In FIGS. 15 and 16 a suitable gear reducer apparatus 350 is connected to the end of the shaft by a chain drive 351 operating over sprockets 353 and 355 attached respectively to the capstan shaft and the drive shaft 357 of the gear reducer 350. An output shaft 359 of the gear reducer 350 has mounted upon it a contact plate 361 having a series of holes 363 in it arranged in two concentric rings 365 and 367. Contact pins 369 are provided which fit in the holes 363. These contact pins contact electric switches 371, which are off switches for the motor, and switches 373, which are on switches for the motor. The switches may be arranged in various combinations and circuits with the power supply for the motor so that the motor may be activated by one contact switch and deactivated by another. Alternatively the switches may be universal contact switches of the type which when operated open the circuit if the circuit was previously closed and close the circuit if it was previously open. If this type of switch is used it is usually necessary to have only one ring of contact holes. The gearing of the gear reducer is designed to provide one rotation of the contact plate for the number of rotations which the capstan makes from the bottom to the top of the pumping stroke.

If desired it will also be convenient to use in place of the above mentioned mechanical control arrangement a variable resistance or potentiometer type detector coupled to the capstan and calibrated to put out a signal the strength of which is proportional to the position of the capstan shaft. Suitable electronic circuits well known to those skilled in the electronics and control arts can be used to open and close the prime mover energization and deenergization switches or circuits at the proper times dependent upon the position of the capstan indicated by the signal derived from the potentiometer. An improved control apparatus for this purpose which combines the capstan positional signal with a load signal from a load cell which detects the load on the pumping string and energizes the starting circuits for the prime mover at a particular load condition of the pumping string within the usual starting range of the apparatus based upon the capstan position is disclosed and claimed in an application entitled "Method and Means for Controlling Longstroke Pumping Units" filed concurrently with this application by the present inventor.

In one actual embodiment of the cam type capstan pumping apparatus shown in FIGS. 11, 12, 13, 14A, 14B and 14C the constant diameter well cable rim 280 and constant diameter counterweight cable rim 281 are each 56 inches in diameter and arranged concentrically with the axis of revolution of the capstan. Each rim has two grooves in its surface adapted to conduct a cable about it for two wraps. The large diameter common central up cam 291 is 68 inches in diameter and arranged eccentrically so that its singly grooved surface is eccentric with respect to the axis of rotation of the capstan, its surface is tangent with the surfaces of the well cable and counterweight cable rims 280 and 281 and its central axis is 6 inches below the axis of rotation when the tangent point is at the top of the capstan.

The two outer down cam rims 289 and 291 are, on the other hand, 46 inches in diameter, have their surfaces tangent to the common tangent point and their centers or central axis 5 inches above the axis of rotation of the capstan as a whole when the tangent point of the various rims is rotated into position at the top of the capstan. These down cam portions of the capstan also have a single groove since the cable cannot progress any farther than to the ends of the capstan. Such a capstan will have a total rotation during a 40 foot pumping stroke of three complete revolutions, two of which will be in the central portion of the stroke while the pumping motor is activated and one-half revolution each is at the end of each stroke while the cables are on the up cam and down cam portions of the pumping apparatus. It has been found that this relationship provides the maximum efficiency with the least complicated capstan construction and the least shock loading during turn-around.

It has been found generally that an up cam having a maximum torque arm approximately 20 to 30 percent greater than the basic constant diameter well cable and counterweight cable sections of the capstan and having a down-cam having a minimum torque arm approximately 15 to 20 percent less than the basic constant diameter well cable and counterweight sections of the capstan will attain maximum efficiency. These percentages are approximately 21.4% and 17.8% respectively for the maximum and minimum torque arms of the actual embodiment of the invention set forth above.

In FIG. 17 there is shown an elevation of an idealized capstan constructed in accordance with the basic invention. The capstan in FIG. 17 is shown as having a constant diameter well cable section 301, and a variable counterweight section 302 which includes a constant diameter counterweight portion 303, a decreasing counterweight portion 305 and an increasing diameter counterweight portion 307. The capstan contour shown in FIG. 17 illustrates the basic principles of the invention. As explained in more detail above, with respect to the specific embodiment of the invention shown in the various preceding FIGURES, the well cable will extend from the well cable section 301 while the counterweight cable will extend in the opposite direction from the counterweight section 302. The well cable will be attached customarily to the capstan at the extreme left of the capstan and the counterweight cable will be secured to the capstan at the extreme right of the capstan at the minimum diameter of the decreasing diameter portion 305 of the counterweight section.

During operation the counterweight cable will travel back and forth across the face of the capstan within the counterweight cable section and will extend from the constant diameter portion of the counterweight section when the motor is operating in the central portion of either the upstroke or downstroke. The counterweight cable will extend substantially from the top or maximum diameter portion of the increasing diameter portion 307 of the counterweight cable section 302 at the bottom of the downstroke, and will extend substantially from the bottom or minimum diameter portion of the decreasing diameter portion 305 of the counterweight section 302 of the capstan at the top of the upstroke. In this way the turnaround of the pumping apparatus will be effected only by the relative torque arm of the counterweight cable with respect to the torque arm of the well cable upon the capstan and the motor will be operated only during that central section of the pumping stroke when the respective torque arms of the capstan are not changing. However, as explained previously with respect to the specific embodiments, the activation of the motor can be effected at the end of either the increasing or decreasing diameter spiral portions 307 and 305 just before the counterweight cable enters upon the constant diameter portion 303 of the counterweight portion 302 of the capstan. The effective torque arm of the counterweight upon the capstan at these points is in the direction which aids the motor operation. In this manner a minimum expenditure of outside energy derived from the motor is required to operate the pumping cycle and the motor is exposed to a minimum constant load and to minimum shock loading the pumping cycle.

FIG. 18 shows a force diagram illustrating the forces and movements during the pumping cycle using the capstan contours shown in FIG. 17. In this force diagram the line 401 indicates the initial portion of the upstroke when the force upon the pumping strand increases substantially proportionately with the upward travel of the pumping strand. The line 403, on the other hand, indicates a portion of the upstroke of the apparatus when the pumping strand continues its upward movement with substantially no additional stress or force upon the cable. Line 405 indicates the initial portion of the downstroke during that period when the downstroke is accelerating and the force on the pumping cable is decreasing. Line 407 indicates that portion of the pumping cycle wherein the pumping cable continues its downward movement with substantially no change in the force or stress upon the cable. The dotted line 409, also indicated as "*cb*" for counterbalance, indicates the travel and forces upon the counterbalance cable during the upstroke of the pumping apparatus. Line 411 indicates the central portion of the counterbalance travel where the forces upon the counterbalance cable are substantially constant. Line 413 on the other hand indicates a portion of the counterbalance cycle during the initial portion of the downstroke. The inclination of the counterbalance lines 409, 411 and 413 also indicate substantially the countour of the counterbalance section of the capstan. Upon comparing the counterbalance line in FIG. 18 and the contour of the capstan in FIG. 17, it will be noted that the counterbalance lines are in substantial conformance with the contour of the capstan.

The points MA on the force diagram in FIG. 18 indicate the points at which the motor may be activated and the points MD indicate those points at which the motor will be deactivated. It will be noted that the central area between MA and MD is the area between which the motor operates and that this area conforms substantially with the central horizontal portion of both the force lines for the well cable and the force lines for the counterweight. The area of upstroke work is indicated above the force diagram and it will be noted also that this corresponds with the distance between the motor activation and the motor deactivation points. Likewise the downstroke work indicated below the force diagram extends between the motor activation and motor deactivation points for the downstroke.

The force diagram shown in FIG. 18 is outlined as an idealized version of the force diagram which will be shown by the usual dynamometer card using the capstan of the invention. Beginning with the downstroke, when the downstroke ends and the upstroke begins, the load will be near its minimum value. At this time the counterbalance torque arm, or effective lever arm, is at its maximum, and this serves to increase the effect of the counterweight balance weight to its maximum. Since the counterbalance is effectively so much heavier than the well load at this point, a reversing force is present which will be equal in magnitude to the difference between the two effective loads. After reversal of the pumping stroke occurs the well load is picked up. The time required to reach maximum upstroke load will be a function of the pick-up speed in the well. Just prior to the time where the rotating mass of the capstan has reached its maximum velocity, the driving motor will be switched on. The speed of the rotating mass of the capstan at this point will be dependent upon the force supplied by the falling counterbalance mass. This mass is effectively greater at this point than the force necessary to lift a well load. Since the counterbalance mass is accelerating downward, its effective weight will be slightly reduced by its own inertia, but this effect will be minimal. Since the driving motor is not switched on or activated until rotation of the capstan has been initiated in the proper direction, the starting current will be greatly reduced and the motor can quickly accelerate to its full load speed. At this point, the counterbalance effect is still high and the counterweight balance will minimize the energy requirements to accelerate to full load speed.

When the motor reaches full speed it will continue at this speed until the motor is switched off or deactivated. At this point the load is much larger than the counterbalance effect and the stroke will start slowing down. At this point the counterbalance cable spiral will start toward its minimum diameter. As the counterbalance effect is reduced the force available to stop and reverse the drum of the capstan becomes larger and larger. However, since the counterbalance is being decelerated, its effective weight will be slightly increased by its own inertia. This effect may be considered minimum. As before the force difference between the well load and the counterbalance will stop the motion of the pumping cycle and initiate motion in the opposite direction. This reversing force will drive the drum of the capstan to some maximum velocity before the force difference will allow it to start slowing down. When it has reached the maximum velocity, just prior to slow down, the motor will be activated, or switched on, and will then bring the load up to the desired pumping cycle speed. Since the motion of the pumping stroke has already started in the proper direction and the force difference is low, the starting current in the motor will be low and the motor can quickly bring the pumping apparatus to full load speed.

Once again the motor carries the load until the motor is switched off. At this point the counterbalance drum starts its upward spiral which increases the counterbalance effect and causes the motion of the pumping stroke to cease and the motion of the drum to reverse.

In the middle of the pumping stroke the work done is a function of the difference in load between the counterbalance effect and the maximum and minimum load.

In FIG. 19 there is shown an elevation of another idealized contoured capstan in accordance with the invention. The same portions and sections of the surface of the capstan are shown in FIG. 19 as are shown in FIG. 17 with the addition, however, of a constant minimum diameter portion 309 of the counterweight balance section of the capstan and a second constant maximum diameter portion 311 of the counterweight balance section of the capstan. In FIG. 20 there is shown a force diagram with a counterbalance load line "*cb*" superimposed upon it for the capstan contour shown in FIG. 19. The capstan contour in FIG. 19 maintains the counterbalance effect at a minimum and maximum value through a longer period of time. This arrangement serves to stop and reverse the pumping apparatus more quickly and brings the pumping apparatus to a higher initial pumping stroke velocity. The contours also keep load differences at a minimum value until the motor has reached its full load speed.

In FIG. 21 there is shown an elevation of still another idealized contour of a preferred embodiment of the invention. The countour of the capstan shown in FIG. 21 includes the same diameter portions of the counterweight section of the capstan as are shown in FIG. 19 and also the same constant diameter portion of the well cable section of the capstan. However, in addition there are provided in the well cable section of the capstan an increasing diameter portion 313 which is analogous to the increasing diameter portions 307 of the counterweight sections and a decreasing diameter portion 315 of the well cable section of the capstan which is likewise analogous to the decreasing diameter portion of the counterbalance section of the capstan 305. Likewise the well cable section of the capstan may incorporate a minimum constant diameter portion 317 analogous to the minimum constant diameter portion 309 of the counterbalance section of the capstan. It will also be understood that the maximum constant diameter portion 311 of the counterweight section of the capstan will double as a maximum constant diameter portion of the well cable section of the capstan.

The capstan shown in FIG. 21 operates essentially in the same manner as the capstan shown in FIG. 19, but with the addition of an extra force, or extra differential weight effect, in the various portions of the pumping cycle due to the changing lever or torque arms of the well cable as well as the counterbalance cable upon the surface of the capstan. In other words, when the effective counterbalance weight is being maximized by the counterweight cable extending from the maximum diameter section 311 of the capstan, the effective layer or torque arm of the well cable will be minimized by extending from the minimum diameter portion 317 of the well cable section. In a like manner, when the torque arm of the well cable is maximized by extending from the maximum diameter portion 311 of the capstan the torque arm of the counterbalance cable will be minimized by extending from the minimum diameter portion 309 of the counterbalance section of the capstan. The effect, therefore, is the same as in the previous embodiments, but the relative difference in pitch and differential heights between the increasing and decreasing diameter portions and maximum and minimum constant diameter portions of the counterbalance portion of the capstan with respect to the constant diameter section of the well cable section of the capstan may be decreased. A somewhat smoother operation and change in speeds of the pumping stroke is therefore attained.

In FIG. 22 there is shown an elevation of a preferred form of up-cam, down-cam type of capstan similar to that shown in FIGS. 11, 12, 13, 14A, 14B and 14C, but incorporating the very desirable constant diameter end sections described previously. This capstan is essentially equivalent to the capstan shown in FIG. 21 for an increasing and decreasing spiral type capstan and the sections are designated with the same designating numerals. The capstan is shown turned to the same position as the eccentric cam type capstan shown in FIG. 13 in order to facilitate identification of the various sections. It will be noted that the portions 303, 305 and 307, and 301, 313 and 315 are all tangent to each other at one point — which is positioned in the FIGURE at the top — while the large concentric portion 311 is concentric with the up-cams 307 and 313 at the opposite side — here the bottom — and the concentric portions 304 and 317 are tangent with the down-cams 305 and 315 also at the opposite side, or here the bottom.

For convenience in referring to the various sections of the capstan of the invention, the well cable or pumping string section of the capstan can be referred to as a first section of the capstan, while the counterweight section can be referred to as the second section of the capstan. The second or counterweight section can then be described as being made up of an initial constant diameter portion, which it will be understood, will in all cases have a constant distance between the axis of rotation of the capstan and the grooved surface, a secondary grooved portion in which the distance of the surface from the axis of rotation of the capstan progressively decreases over a least a section of the circumference of the capstan, and a tertiary grooved portion in which the distance of the surface from the axis of rotation of the capstan progressively increases over at least a section of the circumference of the capstan. Additional fourth and fifth grooved portions in which the distance from the axis of rotation to the surface of the section remains constant and having constant diameters equal to the minimum and maximum distances of the changing sections may be used at the ends of the said changing sections. Similar portions may be incorporated, if desired, into the first pumping string capstan section. The increasing or decreasing distances of the surface of the capstan from the axis of rotation may be attained either by the use of constantly or geometrically changing surfaces which remain substantially concentric with the axis of rotation, or by the use of eccentric cam sections.

While the various embodiments of the capstan arrangement of the invention have been illustrated above with either constantly or linearly decreasing and increasing sections or alternatively with eccentric cam type decreasing and increasing sections and it has also been disclosed that linearly decreasing or increasing cam type sections could also be used, it should also be understood that a single capstan might have a mixed construction, i.e. some of the decreasing or increasing sections in a single capstan might be of a spiral concentric construction while others are of an eccentric cam type construction.

I claim:

1. Improved longstroke pumping apparatus for oil well pumping comprised of:

(i) a reversible prime mover means, (ii) rotatable grooved capstan means arranged to be periodically driven by said prime mover means during a pumping cycle, (iii) a flexible linear force transmitting means for operatively connecting said rotatable grooved capstan means to a pumping string and to a counterweight which at least partially counterbalances the weight of the pumping string, (iv) said rotatable grooved capstan means having a first or well cable section from which the flexible force transmitting means connecting to the pumping string extends and a second or counterweight section from which the flexible force transmitting means connecting to the counterweight extends, the improvement wherein:

(a) the grooved capstan has a surface contour comprising (1) a substantially constant diameter portion constituting a substantial portion of the first or well cable section;

(2) an initial substantially constant diameter grooved portion constituting a substantial portion of the second or counterweight section, (3) a secondary grooved portion adjacent one end of the initial constant diameter portion of the counterweight section and having grooves interconnecting with grooves of the initial portion, in which secondary portion the diameter of the capstan decreases from the diameter of the initial constant diameter portion, (4) a tertiary grooved portion adjacent the opposite end of the initial constant diameter portion and having grooves interconnecting with the grooves of the initial portion, in which tertiary portion the diameter of the capstan increases from the diameter of the initial portion, (b) means to activate the prime mover means as the flexible force transmitting means connecting the capstan to the counterbalance passes from the secondary to the initial portion and from the tertiary to the initial portion of the second section of the capstan, and (c) means to deactivate the prime mover means as the flexible force transmitting means connecting the capstan to the counterbalance passes from the initial portion to the secondary portion and from the initial portion to the tertiary portion of the secondary section of the capstan.

2. A longstroke pumping apparatus according to claim 1 additionally comprising under subparagraph (a):

(5) a further grooved portion adjacent to the first well cable section the grooves of which interconnect with the grooves of said well cable section in which further grooved portion the diameter of the capstan increases from the diameter of the substantially constant diameter portion of the first well cable section.

3. A longstroke pumping apparatus according to claim 1 additionally comprising under subparagraph (a):

(5) a fourth grooved portion adjacent to the secondary portion of the counterweight section of the capstan, the grooves of said fourth portion interconnecting with the grooves of the secondary portion, the fourth portion having a constant minimum diameter equal to the minimum diameter of the secondary portion of the capstan, (6) a fifth grooved portion adjacent to the tertiary portion of the counterweight section of the capstan the grooves of said fifth portion interconnecting with the grooves of the tertiary portion, the fifth portion having a constant maximum diameter equal to the maximum diameter of the tertiary portion of the capstan.

4. A longstroke pumping apparatus according to claim 3 additionally comprising under subparagraph (a):

(7) a sixth grooved portion adjacent to the constant diameter portion of the well cable section and having grooves interconnecting with the grooves of the constant diameter portion, in which sixth portion the diameter of the capstan increases from the diameter of the constant diameter portion.

5. A longstroke pumping apparatus according to claim 4 additionally comprising under subparagraph (a):

(8) a seventh grooved portion adjacent to the opposite end of the constant diameter portion of the well cable section and having grooves interconnecting with the grooves of the constant diameter portion, in which seventh portion the diameter of the capstan decreases from the diameter of the constant diameter portion.

6. A longstroke pumping apparatus according to claim 5 additionally comprising under subparagraph (a):

(9) an eighth grooved portion adjacent to the seventh grooved portion and having grooves interconnecting with the grooves of the seventh grooved portion, the eighth portion having a constant minimum diameter equal to the minimum diameter of the seventh portion.

7. A longstroke pumping apparatus comprised of:

(i) a reversible drive motor means, (ii) rotatable grooved capstan means arranged to be periodically driven by said motor means during pumping, (iii) a flexible linear force transmitting means for operatively connecting said rotatable grooved capstan means to a pumping string and to a counterweight which at least partially balances the weight of the pumping string, (iv) said rotatable grooved capstan means having a first pumping string section from which the flexible linear force transmitting means connecting to the pumping string extends during the pumping cycle and a second counterweight section from which the flexible force transmitting means connecting to the counterweight extends during the pumping cycle, the improvement wherein the first section of the capstan is comprised of a grooved surface portion having a constant distance between the grooved surface and the axis of rotation of the capstan, and the second section of the capstan is comprised of:

(a) an initial grooved surface portion having a constant distance between the grooved surface and the axis of rotation of the capstan, (b) a secondary grooved surface portion adajcent one side of the initial grooved surface portion and having a decreasing distance between the grooved surface and the axis of rotation of the capstan and in which the maximum distance is equal to the distance in the initial portion, and (c) a tertiary grooved surface portion adjacent the opposite side of the initial grooved surface portion and having an increasing distance between the grooved surface and the axis of rotation of the capstan and in which the minimum distance is equal to the distance in the initial portion, the grooves of the initial grooved surface portion being interconnected with the grooves of the secondary grooved surface portion and the tertiary grooved surface portion such that the flexible force transmitting means connected to the counterweight extends during various portions of the pumping cycle of the pumping apparatus from each of the three portions of the second section of the capstan.

8. A longstroke pumping apparatus according to claim 7 additionally comprising:

(d) a fourth grooved surface portion having a constant distance between the grooved surface and the axis of rotation which distance is equal to the minimum such distance of the secondary portion and the grooves of which are connected to the grooves of the secondary portion, (e) a fifth grooved surface portion having a constant distance between the grooved surface and the axis of rotation which distance is equal to the maximum such distance of the tertiary portion and the grooves of which are connected to the grooves of the secondary portion.

9. A longstroke pumping apparatus according to claim 8 wherein the first section of the capstan has substantially equivalent portions corresponding to the several portions of the second capstan section.

10. A longstroke pumping apparatus according to claim 9 wherein the secondary and tertiary portions are formed from grooved surfaces substantially concentric with the axis of rotation of the capstan.

11. A longstroke pumping apparatus according to claim 10 wherein the secondary and tertiary portions are comprised of constant spiral sections.

12. A longstroke pumping apparatus according to claim 9 wherein the secondary and tertiary portions are formed from cam sections eccentric with respect to the axis of rotation.

13. An improved oil well pumping apparatus according to claim 12 wherein the second well cable cam section and the second counterweight cam section are comprised of separate cam sections and additionally comprising (g) a constant diameter grooved drum section positioned between the two second cam sections concentric with the axis of rotation of said capstan and having a radius equal to the maximum distance between the axis of rotation of the capstan and the grooved surface of the two second cam sections and tangent at the point of said maximum distance with said cam sections, the grooves on the surface of the constant diameter drum section interconnecting with the grooves on the surface of the two second cam sections, and (h) a pair of substantially constant diameter grooved drum sections positioned respectively adjacent to and on the outside of the first substantially constant diameter grooved well cable cam section and the first substantially constant diameter grooved counterweight cam section concentric with the axis of rotation of said capstan and having radii equal to the minimum distance between the axis of rotation of the capstan and the grooved surface of the two first substantially constant diameter grooved cam sections and tangent at said point of minimum distance with said cam sections, the grooves on each of the substantially constant claimed drum sections interconnecting with the grooves on the surface of the adjacent cam sections.

14. An improved oil well pumping apparatus according to claim 13 wherein the capstan has a cable retainer about its circumference spaced from the operative body components of the capstan and has a spiraled-in deadend at each longitudinal end of the capstan to which the flexible linear force transmitting means are secured.

15. An improved oil well pumping apparatus comprised of:

(i) a reversible prime mover means, (ii) rotatable grooves capstan means arranged to be periodically driven by said prime mover means during pumping, (iii) a flexible linear force transmitting means for operatively connecting said rotatable grooved capstan means to a pumping string and to a counterweight which at least partially counterbalances the weight of the pumping string, (iv) said rotatable grooved capstan means having a first or well cable section from which the flexible force transmitting means connecting to the pumping string extends and a second or counterweight section from which the flexible force transmitting means connecting to the counterweight extends, the improvement wherein the first or well cable section of the capstan is comprised of (a) a substantially constant diameter grooved well cable drum section concentric with the axis of rotation of said capstan, (b) a first substantially constant diameter grooved well cable cam section adjacent to one end of said well cable drum section and having a smaller diameter than said drum section, the grooved surface of said first cam section being tangent at one point with the grooved surface of said drum section, the grooves of the drum section and cam section being interconnecting, and (c) a second substantially constant diameter grooved well cable cam section adjacent to the other end of said drum section and having a larger diameter than said drum section, the grooved surface of said second cam section being tangent at one point with said drum section and said first cam section, the grooves of said drum section and second cam section being interconnecting, and the second or counterweight cable section being comprised of (d) a substantially constant diameter grooved counterweight cable drum section concentric with the axis of rotation of said capstan, (e) a first substantially constant diameter grooved counterweight cable cam section adjacent to one end of said counterweight cable drum section and having a smaller diameter than said drum section, the grooved surface of said first cam section being tangent at one point with the grooved surface of said drum section, the grooves of the drum section and cam section being interconnecting, and (f) a second substantially constant diameter grooved counterweight cable cam section adjacent to the other end of said drum section and having a larger diameter than said drum section, the grooved surface of said second cam section being tangent at one point with said drum section and said first cam section, the grooves of said drum section and said second cam section being interconnecting.

16. An improved oil well pumping apparatus according to claim 15 wherein the well cable drum section and counterweight drum section have substantially equal constant diameters.

17. An improved oil well pumping apparatus according to claim 16 wherein the second well cable cam section and second counterweight cam section are comprised of the same physical cam section.

18. An improved oil well pumping apparatus according to claim 17 wherein the well cable drum section and counterweight drum section have substantially equal constant diameters.

19. An improved oil well pumping apparatus according to claim 18 wherein the capstan has a cable retainer about its circumference spaced from the operative body components of the capstan and a spiraled-in deadend at the outer ends of the capstan.

* * * * *

UNITED STATES PATENT OFFICE
CERTIFICATE OF CORRECTION

PATENT NO. : 4,076,218

DATED February 28, 1978

INVENTOR(S) : Robert H. Gault

It is certified that error appears in the above-identified patent and that said Letters Patent are hereby corrected as shown below:

Col. 1, line 46, after "which" the word --the-- should be inserted

Col. 2, line 10, the word "stroke" should read --string--.

Col. 4, line 2, after "suitable" the word "shaft" should be inserted.

Col. 7, line 5, the word "turn" should read --end--.

Col. 8, line 22, "doubled both on" should read --doubles both as--

Col. 8, line 58, the word "of" should be deleted.

Col. 10, line 37, "64" should read --63--.

Col. 10, line 47, the word "effect" should read --effective--.

Col. 10, line 53, the word "being" should read --begin--.

Col. 10, line 58, the word "layer" should read --lever--.

Col. 16, line 7, "63" should read --263--.

Col. 16, line 67, "section" should read --sections--.

Col. 19, line 1, "and" should read --or--.

Col. 19, line 2, "an" should read --or--.

Col. 22, line17, "embodiment" should read --embodiments--.

UNITED STATES PATENT OFFICE

CERTIFICATE OF CORRECTION

Patent No. 4,076,218 Dated February 28, 1978

Inventor(s) Robert H. Gault

It is certified that error appears in the above-identified patent and that said Letters Patent are hereby corrected as shown below:

Col. 25, line 18, "layer" should read -- lever --.

Col. 29, line 43, claim 15, subparagraph (ii), "grooves" should read -- grooved --.

Signed and Sealed this

Eighth Day of August 1978

[SEAL]

Attest:

RUTH C. MASON
*Attesting Officer*

DONALD W. BANNER
*Commissioner of Patents and Trademarks*